US007594834B2

(12) United States Patent
Shiomi et al.

(10) Patent No.: US 7,594,834 B2
(45) Date of Patent: Sep. 29, 2009

(54) MARINE PROPULSION APPARATUS

(75) Inventors: Kazuyuki Shiomi, Wako (JP); Takeshi Okada, Wako (JP); Tetsuro Ikeno, Wako (JP); Masayuki Osumi, Wako (JP); Katsuyuki Morichika, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/020,206

(22) Filed: Jan. 25, 2008

(65) Prior Publication Data

US 2008/0182465 A1 Jul. 31, 2008

(30) Foreign Application Priority Data

| | | |
|---|---|---|
| Jan. 26, 2007 | (JP) | 2007-017187 |
| Jan. 26, 2007 | (JP) | 2007-017188 |
| Jan. 26, 2007 | (JP) | 2007-017192 |
| Jan. 26, 2007 | (JP) | 2007-017193 |
| Feb. 19, 2007 | (JP) | 2007-038373 |
| Feb. 20, 2007 | (JP) | 2007-039860 |

(51) Int. Cl.
*B63H 1/18* (2006.01)

(52) U.S. Cl. ..... 440/66

(58) Field of Classification Search ..... 440/66; 114/274

See application file for complete search history.

(56) References Cited

U.S. PATENT DOCUMENTS

| | | | | |
|---|---|---|---|---|
| 2,081,868 A | * | 5/1937 | Hampden | 114/274 |
| 2,748,400 A | * | 6/1956 | Kregall | 114/55.55 |
| 4,756,265 A | | 7/1988 | Lane | |
| 5,638,765 A | * | 6/1997 | Poulos | 114/274 |
| 5,645,009 A | * | 7/1997 | Lexau | 114/274 |

FOREIGN PATENT DOCUMENTS

| | | | |
|---|---|---|---|
| GB | 2117712 A | * | 10/1983 |
| JP | 57-60995 A | | 4/1982 |

* cited by examiner

*Primary Examiner*—Stephen Avila
(74) *Attorney, Agent, or Firm*—Westerman, Hattori, Daniels & Adrian, LLP.

(57) ABSTRACT

A marine propulsion apparatus includes an anti-cavitation plate on a casing that supports a propeller. A lift generation plate, which generates lift during propulsion, is disposed at a position rearward of the casing and above the anti-cavitation plate and extends in a width direction of a hull. The lift generation plate is mounted on the casing via a stay.

11 Claims, 26 Drawing Sheets

FIG.20
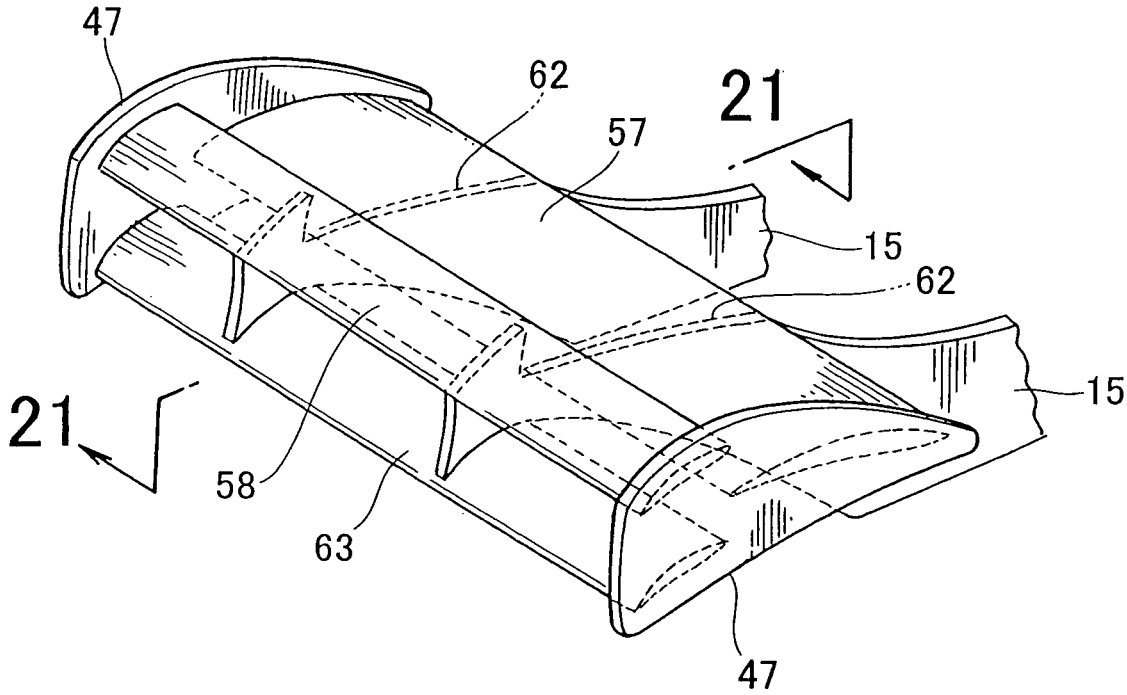
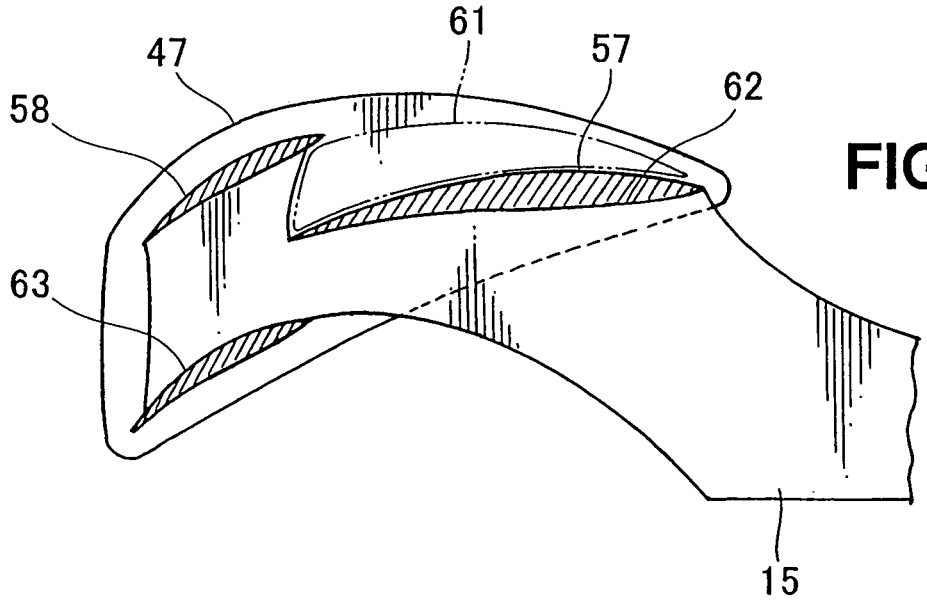
FIG.21

MARINE PROPULSION APPARATUS

FIELD OF THE INVENTION

The present invention relates to a marine propulsion apparatus mounted on the stern of a hull for propelling the hull.

BACKGROUND OF THE INVENTION

A marine propulsion apparatus, also known as an outboard motor, is a heavy engine to be disposed above a screw. The stern is always sunk deeply into the water when such a marine propulsion apparatus is mounted on the stern of a hull. The sinking is reduced when the boat is running at a certain velocity. However, water resistance is considerable, time is required to increase the velocity, and smooth acceleration is difficult to obtain because the depth of the stern in the water is considerable when the boat is accelerating from a stopped state to a running state.

A lift generation plate is effective as a countermeasure to this problem. A lift generation plate is disclosed in, e.g., Japanese Patent Application Laying-Open Publication No. 57-60995 (JP 57-060995 A). This lift generation plate will be described with reference to FIGS. 36, 37 hereof.

An outboard motor 100 is provided with an anti-cavitation plate 103 in the upper section of a casing 102 that supports a propeller 101, as shown in FIG. 36. A splash plate 104 is provided above the anti-cavitation plate 103, and a lift generation plate 105 is disposed above the splash plate 104.

The lift generation plate 105 is a flat plate in which a large concave portion 106 is opened in the center and to which stays 107, 107 are provided at the front end, as shown in FIG. 37. The casing 102 indicated by the imaginary lines is inserted into the concave portion 106 in a relative manner, whereby the lift generation plate 105 is mounted on the casing 102 in the manner shown in FIG. 36. As a result, a dead space 109 indicated by the diagonal lines in FIG. 37 is unavoidably produced. The dead space 109 does not contribute in any way to the generation of lift. The lift obtained by the lift generation plate 105 is therefore reduced.

A structure that can take the place of the structure described above is disclosed in U.S. Pat. No. 4,756,265. This structure will be described with reference to FIG. 38, wherein a lift generation plate 114 is hung on an arm part 113 that extends to the left in the Figure from a casing 112 that supports a propeller 111. In other words, the lift generation plate 114 is disposed near the propeller 111. A vortex is generated when the propeller 111 is rotated at high speed. The lift generation plate 114 is exposed to the vortex. The resulting lift fluctuates because the vortex flow is turbulence. The lift generation plate 114 is moved in the depth direction of the Figure in order to avoid the effect of the vortex. The lift generation plate 114 decreases in size in conjunction with this movement, and the resulting lift is reduced.

In view of the above, there is a need to devise a lift generation plate in which the resulting lift is considerable.

SUMMARY OF THE INVENTION

According to an aspect of the present invention, there is provided a marine propulsion apparatus adapted to be mounted on a stern of a hull for propelling the hull, which apparatus comprises: a casing for supporting a propeller that propels the hull; a cover extending upwardly from an upper end of the casing and surrounding an engine that drives the propeller; an anti-cavitation plate extending transversely outwardly from the casing for reducing a cavitation phenomenon generated in association with rotation of the propeller; a stay disposed above the anti-cavitation plate and extending rearwardly from the casing; and a lift generation plate supported by the stay at a position rearward of the casing and above the anti-cavitation plate and extending in a width direction of the hull for generating lift during the propulsion.

Since the lift generation plate is disposed above the anti-cavitation plate and is therefore sufficiently away from the propeller, stable lift is generated without fluctuation and without concern of being affected by the vortex. Again, since the lift generation plate is disposed rearward and away from the casing, a concavity is not required to be provided in order to avoid interference with the casing. As a result, the lift generation plate generates a sufficiently large amount of lift.

Preferably, the lift generation plate has a wing tip plate extending vertically and in a front-and-rear direction at opposite ends thereof. Flow that moves from the lower surface of the lift generation plate around to the upper surface can be prevented by the wing tip plates, and a reduction in the resulting lift can be avoided.

Desirably, the center of the lift generation plate be shifted and disposed to the left or the right so as to be offset from the center of the casing. Interference with an adjacent lift generation plate can be avoided by offsetting the lift generation plate. Such a configuration is advantageous when two or three apparatuses are mounted.

In a preferred form, a plurality of marks is provided on the lift generation plate, so that bolt holes may be formed in selected marks, whereby the lift generation plate is offset. The lift generation plate can be disposed at a desired offset position in a simple manner by providing such marks.

It is also preferred that the distal end of the stay be covered by a decorative cover. The external appearance can be enhanced by covering the distal end of the stay with a decorative cover.

Desirably, the stay comprise a wall part U-shaped so as to be able to fit on the rear section of the casing, a terrace part that extends rearward from the upper edge of the U-shaped wall part, and an arm part that extends rearward from the terrace part. Flexing generated in the stay with contribution from the terrace part can be reduced when a horizontal force is applied.

According to another aspect of the present invention, there is provided a marine propulsion apparatus adapted to be mounted on a stern of a hull for propelling the hull, which apparatus comprises: a casing for supporting a propeller that propels the hull; a cover extending upwardly from an upper end of the casing and surrounding an engine that drives the propeller; an anti-cavitation plate extending transversely outwardly from the casing for reducing a cavitation phenomenon generated in association with rotation of the propeller; a stay disposed above the anti-cavitation plate and extending rearwardly from the casing; and a plurality of lift generation plates supported by the stay at a position rearward of the casing and above the anti-cavitation plate and extending in a width direction of the hull for generating lift during the propulsion Since the lift generation plate is disposed above the anti-cavitation plate, and is thus set sufficiently away from the propeller, stable lift is generated without concern of being affected by the vortex. The lift generation plate is disposed rearward from the casing, and a concavity is therefore not required to be provided in order to avoid interference with the casing. As a result, the lift generation plate generates a sufficiently large amount of lift. In addition, the resulting lift is increased because there is a plurality of lift generation plates.

Preferably, the lift generation plates are disposed in a vertically spaced relation to each other. Lift continues to be generated because a lower lift plate is in the water even if an upper lift generation plate has departed from the water surface.

The lift generation plates may be disposed such that they are spaced from each other in a forward-rearward direction. The position of the plurality of lift generation plate can be lowered. A lower position allows lift to be generated in a continuous fashion because the plurality of lift generation plates is in the water over a long period of time. Such a configuration is advantageous for starting in shallow areas.

The lift generation plates may have the same shape. Manufacturing costs can be reduced when the parts are the same.

BRIEF DESCRIPTION OF THE DRAWINGS

Certain preferred embodiments of the present invention will be described in detail below, by way of example only, with reference to the accompanying drawings, in which:

FIG. 20 is a schematic view showing the arrangement of three lift generation plates;

FIG. 21 is a cross-sectional view taken along line 21-21 of FIG. 20;

DETAILED DESCRIPTION OF THE PREFERRED EMBODIMENTS

Figure 1:
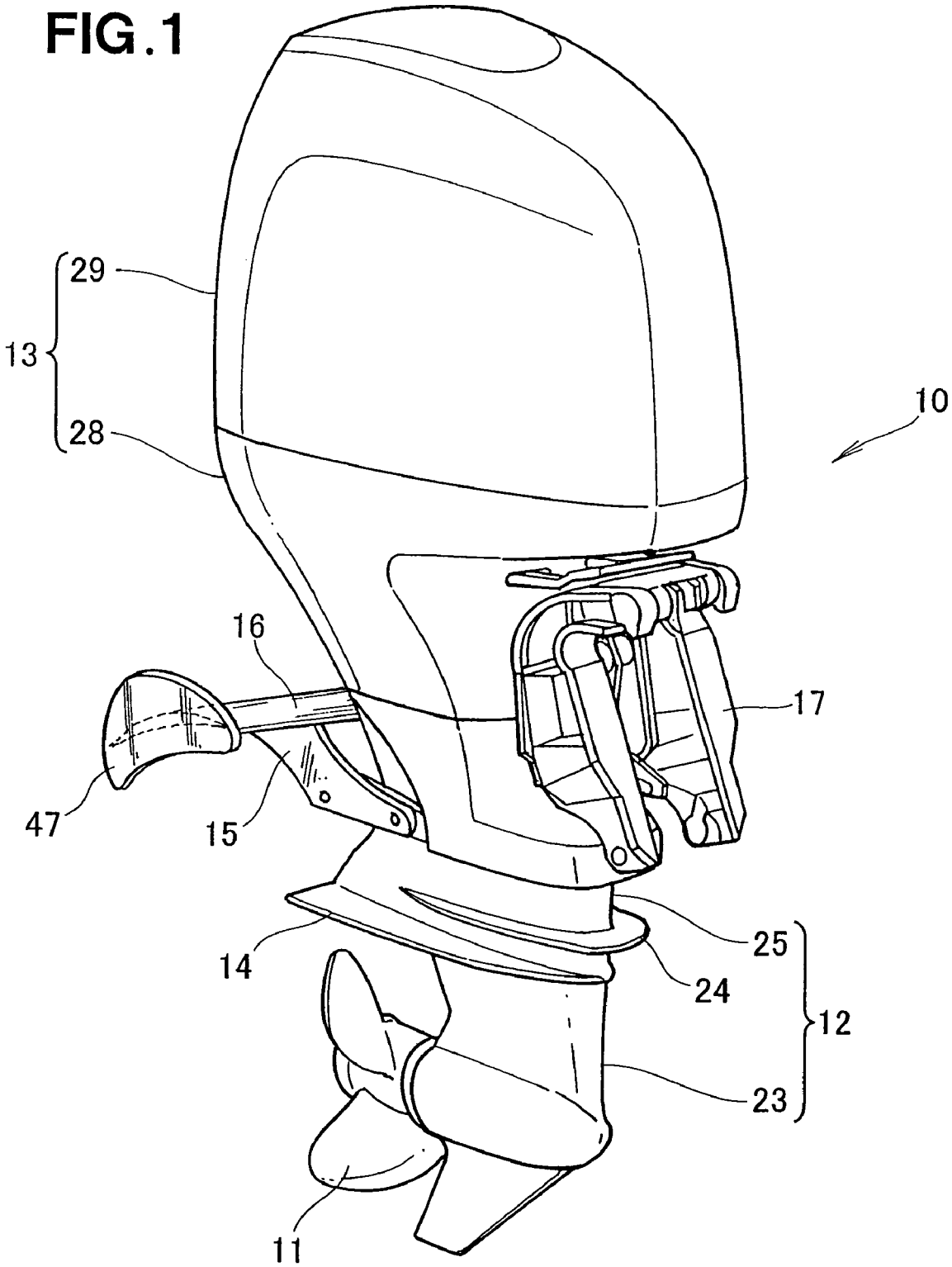
FIG. 1 is a perspective view showing a marine propulsion apparatus according to the present invention.

A marine propulsion apparatus 10 is composed of a casing 12 for supporting a propeller 11, a cover 13 that extends upward from the upper end of the casing 12, an anti-cavitation plate 14 that extends in the left/right direction from the casing 12 and reduces a cavitation phenomenon that is generated together with the rotation of the propeller 11, stays 15 that extends rearward from the casing 13 in a position above the anti-cavitation plate 14; a lift generation plate 16 that is supported by the stays 15 and disposed above the anti-cavitation plate 14 and rearward of the casing 12, and a stern bracket 17 that extends forward from the casing 12, as shown in FIG. 1 as viewed diagonally from the front.

Figure 2:
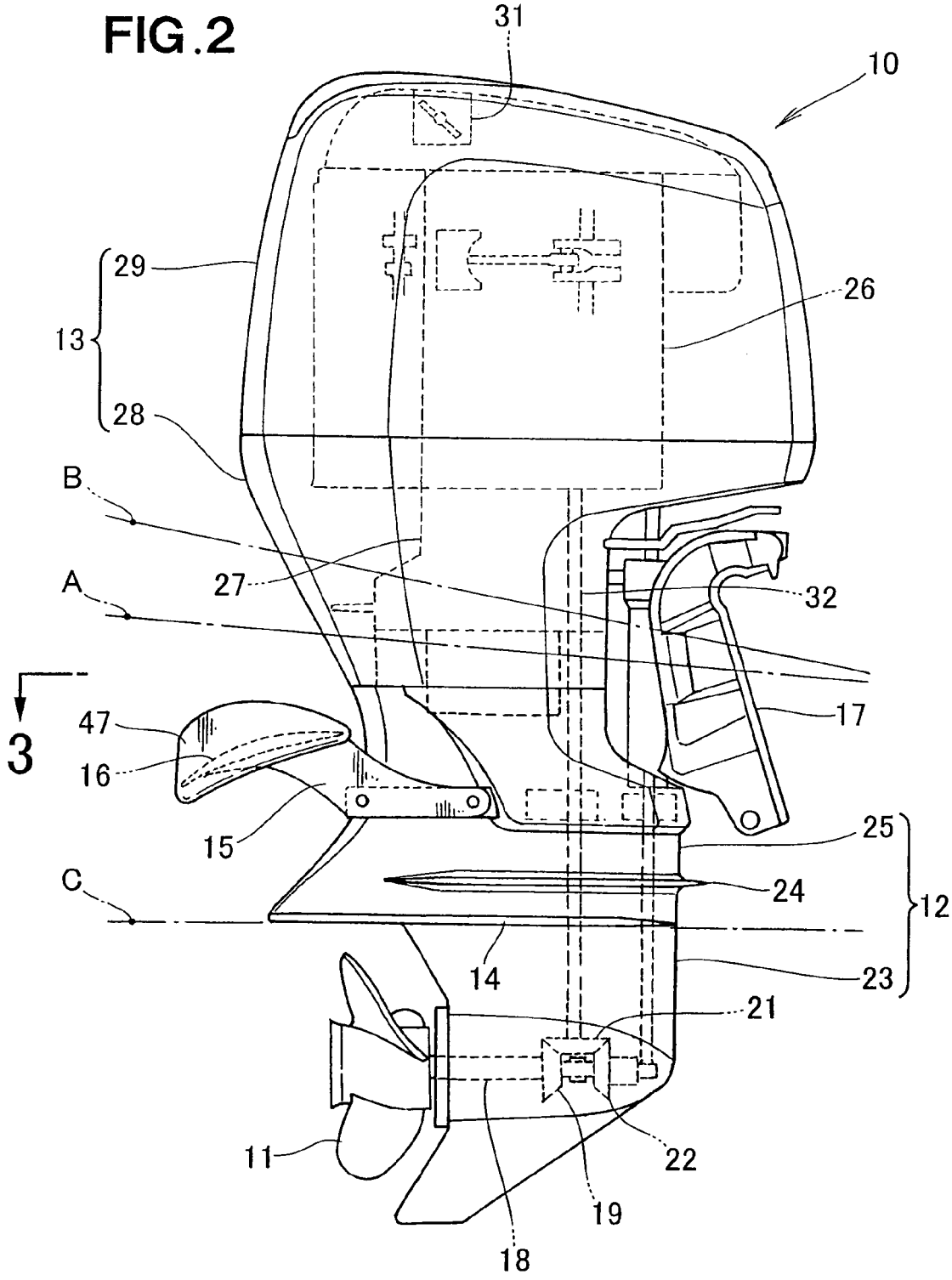
FIG. 2 is a side elevational view of the marine propulsion apparatus.

The structure of the marine propulsion apparatus 10 is described more specifically below with reference to FIG. 2. The casing 12 is divided into a gear case 23 for accommodating bevel gears 19, 21, 22 as well as a propeller shaft 18 that is connected to the propeller 11; and an extension case 25 that is connected to the top of the gear case 23 and in which an anti-splash plate 24 is integrally formed. The casing 12 thus composed of the gear case 23 and the extension case 25 requires rigidity, and is therefore composed of metal, and is more preferably composed of aluminum or another light metal.

The cover 13 is divided into an under cover 28 that is connected to the top of the extension case 25 and surrounds a mount case 27 for supporting the upper portion of an engine 26; and an engine cover 29 that is connected to the top of the under cover 28 and surrounds the engine 26.

A throttle valve 31 is disposed on the upper section of the engine 26, and a drive shaft 32 extends downward from the lower surface of the engine 26. The drive shaft 32 extends vertically downward and is coupled to the bevel gear 21. The drive force of the engine 26 is transmitted to the propeller 11 via the drive shaft 32, the bevel gear 21, the bevel gear 19, and the propeller shaft 18.

In the Figure, line A shows the water level when the boat is stopped. In this case, the entire casing 12 is submerged because the stern is heavy.

Line B shows the water level in the initial stage of travel. The propeller 11 produces propulsion when the boat starts to move, and the stern is therefore further submerged in the water due to a moment that operates in the counterclockwise direction of the surface of the Figure.

Line C shows the water level during ordinary travel. The boat departs from the surface of the water to the extension case 25 because traveling prevents the boat from sinking into the water. The lift generation plate 16 of the present invention is provided for the purpose of reducing the time required to reach line C from line A via line B. In ordinary travel, the lift generation plate 16 does not undergo resistance from the water because it is above the water level. As a result, the boat can easily reach high-speed travel.

In ordinary travel, the vortex produced by the propeller 11 collides with the anti-cavitation plate 14 and is diminished because the water level is at line C. For this reason, the generation of a cavitation phenomenon is reduced. An anti-splash plate 24 exhibits an effect of reducing the splash produced by the stern.

The lift generation plate 16 and stays 15 will be described with reference to FIG. 3, which is a cross-sectional view along the line 3 of FIG. 2.

A relay plate 35 is placed in contact with the casing 12 indicated by an imaginary line via a collar 34 and is fastened using bolts 36, 37. The relay plate 35 is folded so that the outside surface between the front part 38, and the rear section 39 is set to be equidistant from the center line 41 of the casing 12.

As viewed from above, the lift generation plate 16 is a rectangular plate that straddles the center line 41, i.e., extends in the width direction of the hull in a position rearward of the casing 12. The front parts of the stays 15, 15 that extend forward from the lift generation plate 16 are placed in contact with the front part 38 and rear section 39 of the relay plate 35, and are fastened to the relay plate 35 using bolts 42, 43. The length (left/right width) L of the lift generation plate 16 is, e.g., 500 mm, and the width is, e.g., 300 to 350 mm.

Figure 4:
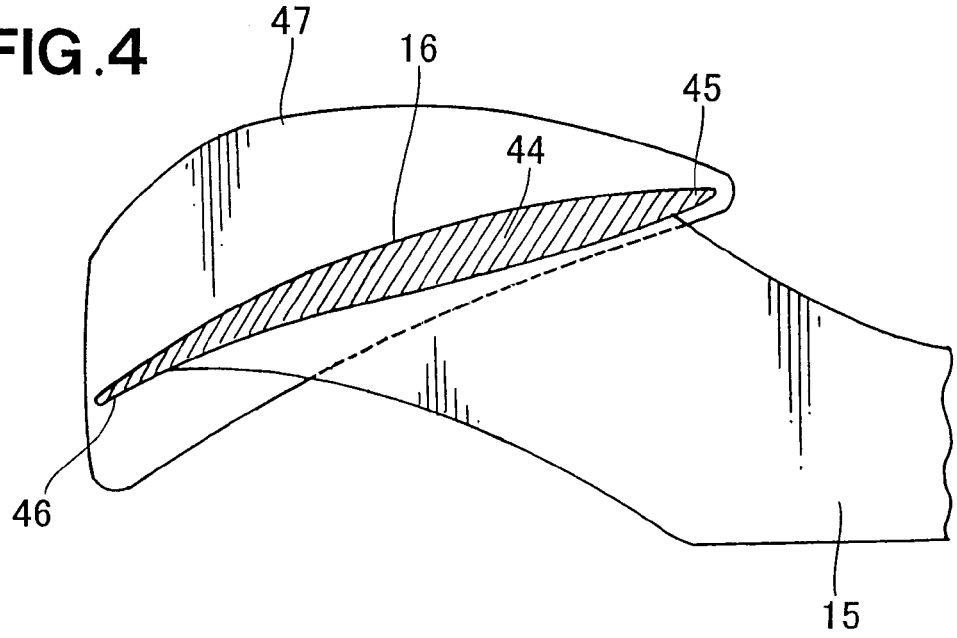
FIG. 4 is a cross-sectional view illustrating the lift generation plate.

A cross-sectional shape of the lift generation plate 16 will be described with reference to FIG. 4. The lift generation plate 16 has a main wing shape in which the center section 44 is thick, the front part 45 and rear section 46 gradually become thinner, the front part 45 is above, and the rear section 46 is lower, as shown in FIG. 4. However, the rear section 46 is thinner than the front part 45.

In the Figure, the pressure on the lower surface side increases and the pressure on the upper surface side decreases due the hydrodynamic phenomenon when the wing advances rightward in the water. The force obtained by multiplying the surface area by the pressure difference is the lift force, and an upward force is applied to the lift generation plate 16.

Figure 5:
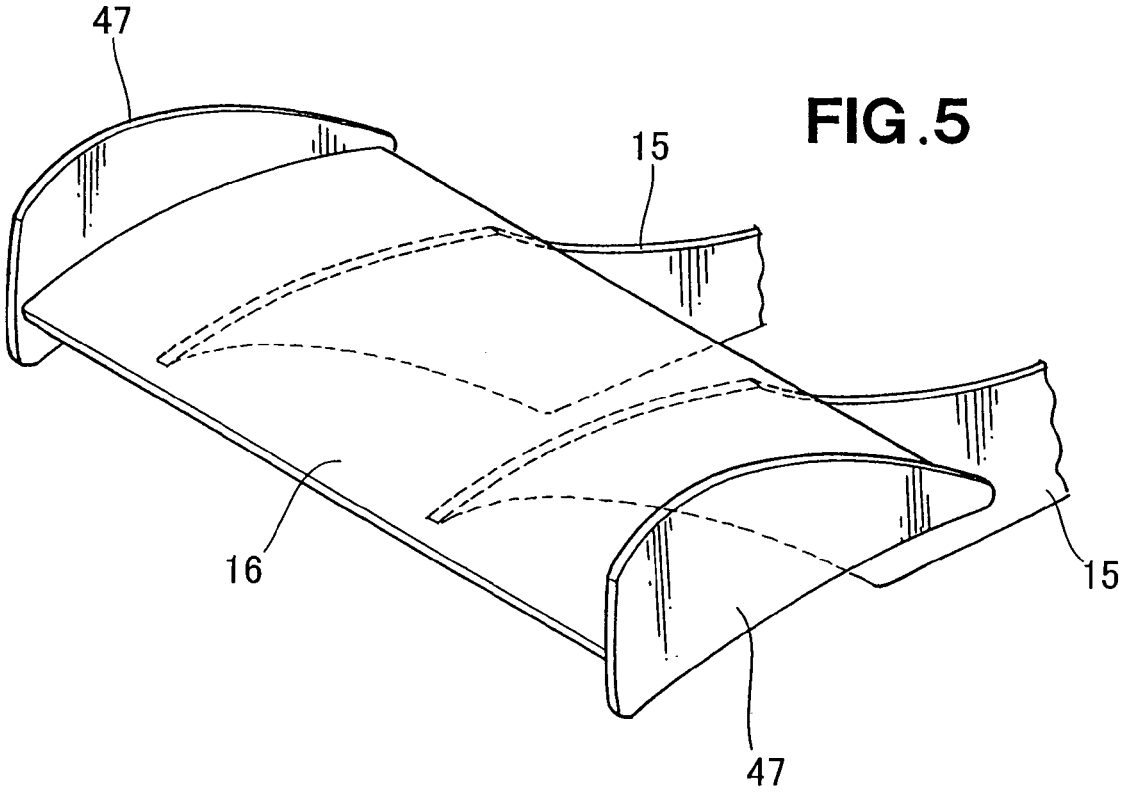
FIG. 5 is a perspective view illustrating the lift generation plate.

The lift generation plate 16 is provided with triangular wing tip plates 47, 47 that extend in the forward/rearward direction and in the up and down directions, i.e., the vertical direction, as shown in FIG. 5.

The wing tip plate 47 acts to increase rigidity in the end section of the lift generation plate 16, and therefore exhibits the effect of reducing flapping (vertical vibrations) that is readily generated in the wing tips. In addition, flow from the lower surface to the upper surface at the wing tips is generated because the upper surface is at a low pressure and the lower surface is under high pressure. Such flow is referred to as side flow, and lift is reduced. A reduction in lift can be prevented by providing a wing tip plate 47.

The lift generation plate 16 is supported by the casing 12 via the stays 15 and is disposed above the anti-cavitation plate 14, as shown in FIG. 1. In other words, the lift generation plate 16 is disposed in an intermediate position between lines A and C. For this reason, the lift generation plate 16 is submerged between the transition from travel startup to normal travel, and lift can be obtained from the water. Since, as shown in FIG. 3, the lift generation plate 16, which is disposed away from the casing 12 and is extended in the width direction of the hull rearward from the casing 12, is sufficiently large, a sufficiently large amount of lift can be obtained, and the process in which the water level moves in a relative manner from line A to line C shown in FIG. 2 is carried out rapidly. As a result, transition from travel startup to normal travel is carried out in a short period of time, and travel can be enjoyed.

The lift generation plate 16 described above is advantageous for the case in which a single marine propulsion apparatus is disposed on the stern. However, there are cases in which two or more marine propulsion apparatuses are disposed on the stern of a relatively large hull. This mode is referred to as a two-engine mode, a three-engine more, or a plural-engine mode.

In a plural engine mode, mutual interference is a problem among the lift generation plates that extend considerably to the left and right. In view of this problem, a marine propulsion apparatus that is advantageous for a plural-engine mode is described below.

Figure 6:
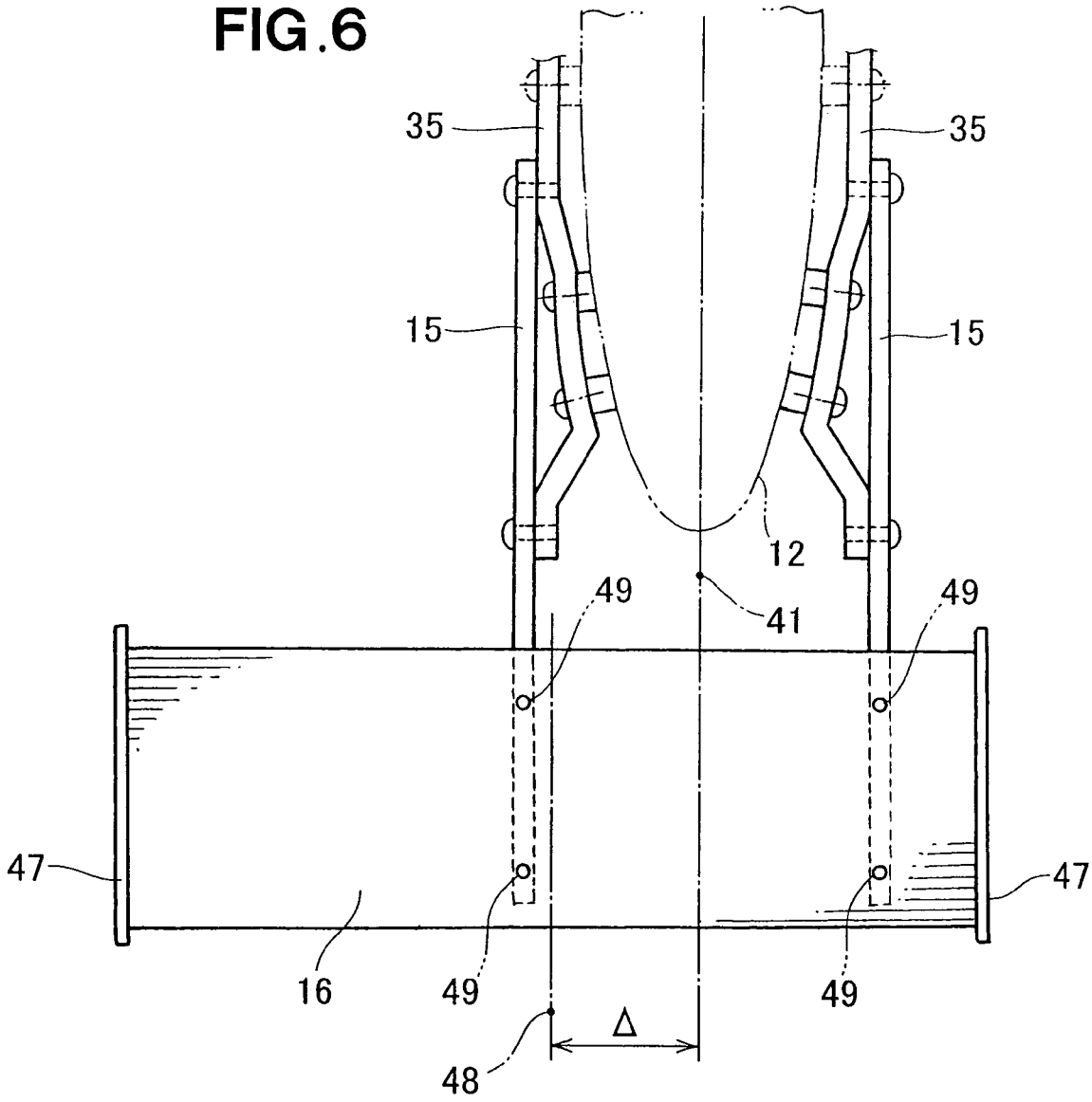
FIG. 6 is a schematic view showing the arrangement of the lift generation plate which is offset to the left.
Figure 7:
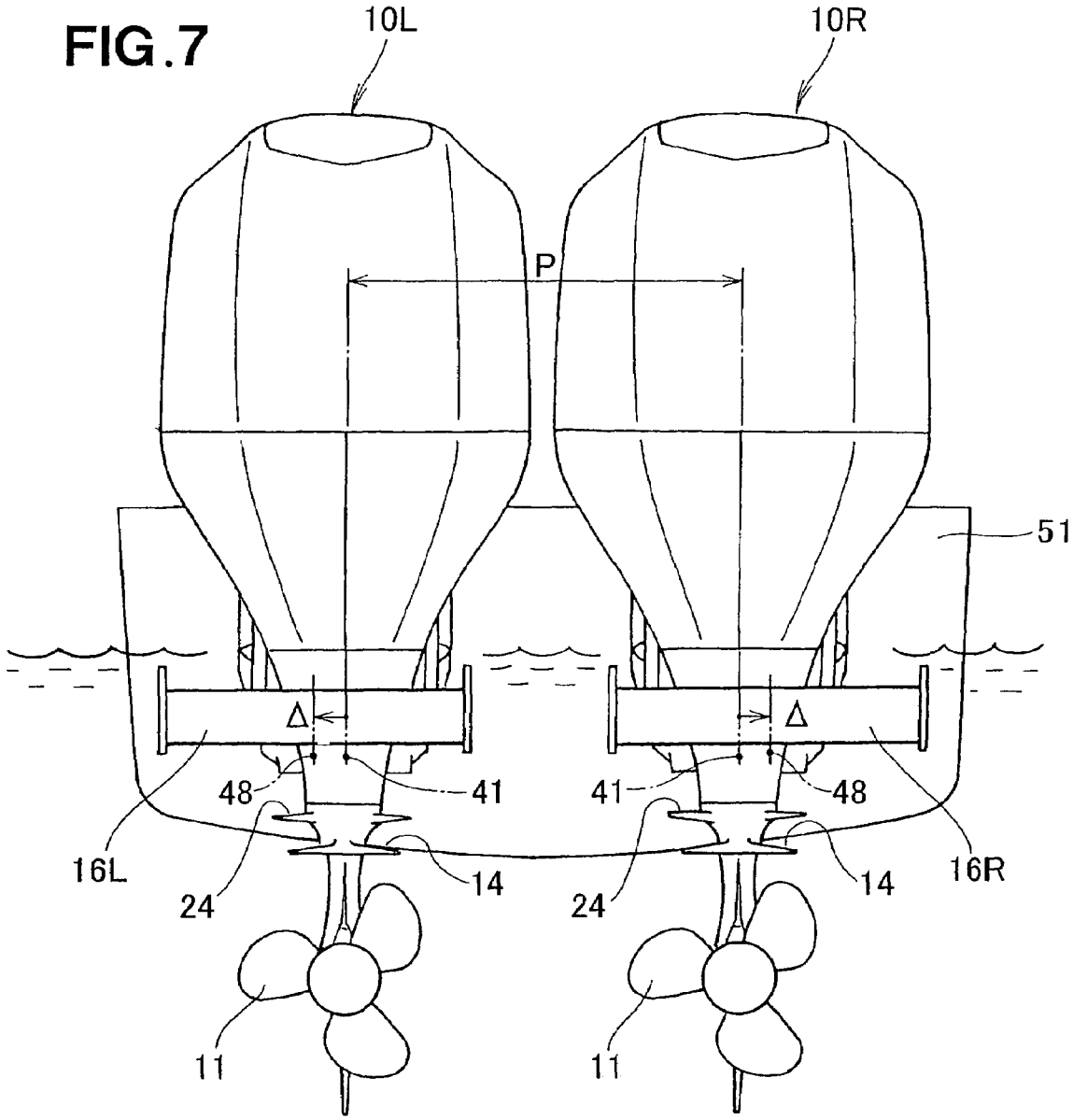
FIG. 7 is a schematic view showing the arrangement of two marine propulsion apparatuses.

First, an example of a two-engine mode will be described with reference to FIGS. 6 to 8.

Bolt holes 49 for fastening are provided to the lift generation plate 16 so that the center line 48 of the lift generation plate 16 is offset by a distance Δ from the center line 41 of the casing 12, and the lift generation plate 16 is fastened to the stays 15, 15 using the bolt holes 49. In the Figures, the lift generation plate 16 is offset to the left, but the lift generation plate may be offset to the right by a distance Δ by changing the position of the bolt holes 49.

A stern 51 can thereby be provided with a marine propulsion apparatus 10L having a lift generation plate 16L that is offset to the left by a distance Δ, and a marine propulsion apparatus 10R having a lift generation plate 16R that is offset to the right by a distance Δ.

Figure 8:
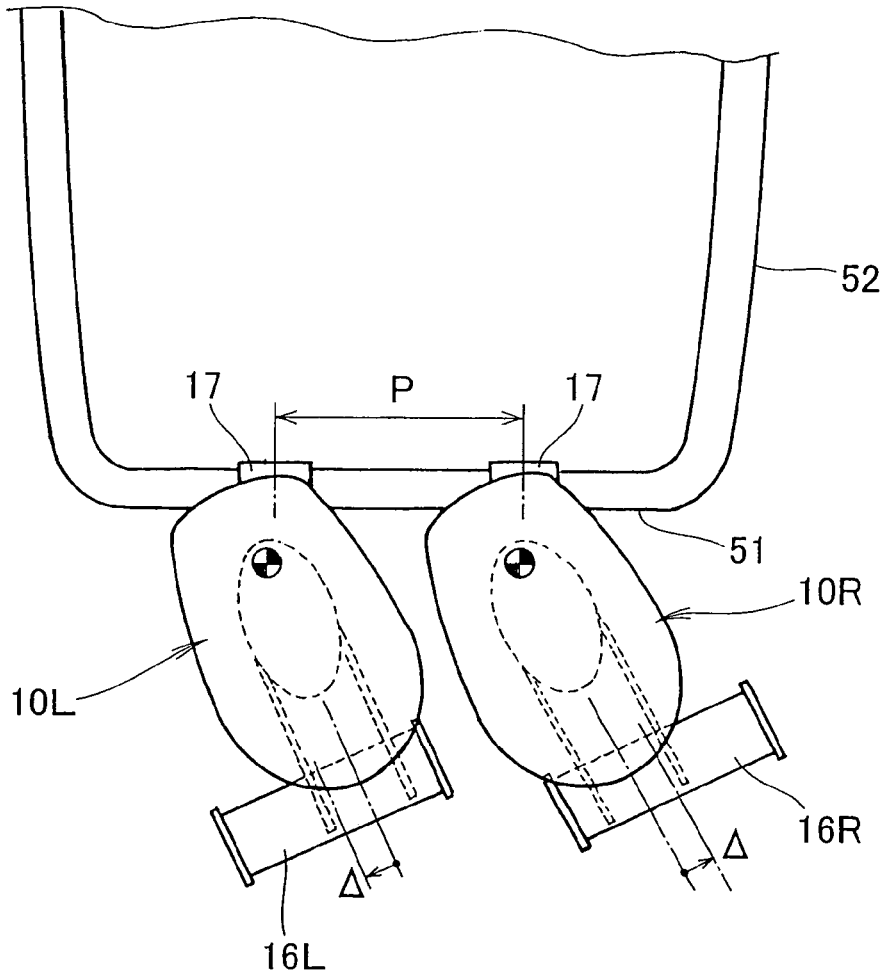
FIG. 8 is a schematic view showing an operation of the two marine propulsion apparatuses.

As a result, there is no concern that the lift generation plates 16L, 16R will interfere with each other even when the marine propulsion apparatuses 10L, 10R are turned so that the hull 52 turns to the right, as shown in FIG. 8. Two marine propulsion apparatuses 10L, 10R can be mounted on a stern 51 having a narrow width because the pitch P between the marine propulsion apparatuses 10L, 10R can be reduced.

Next, an example of a three-engine mode will be described with reference to FIGS. 9 to 13.

Figure 9:
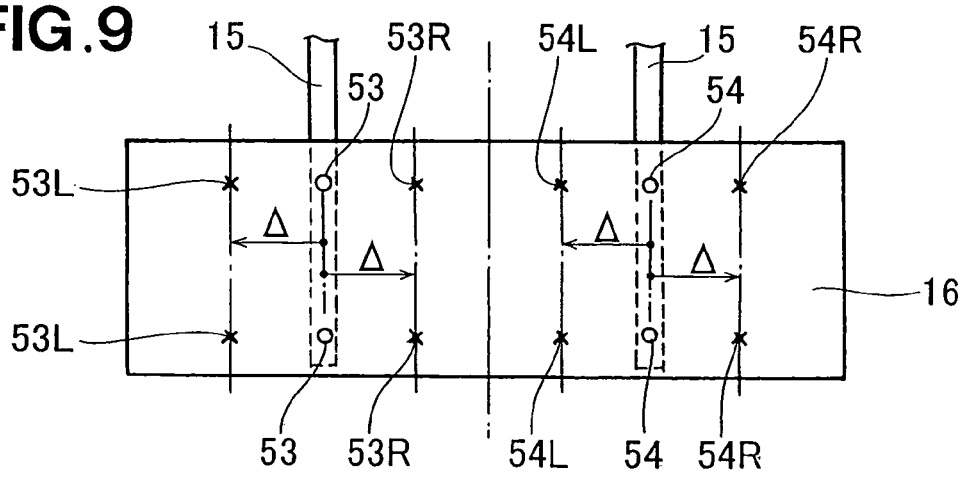
FIG. 9 is a top plan view showing the lift generation plate.
Figure 10:
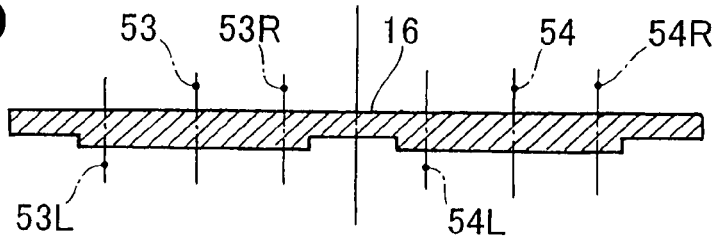
FIG. 10 is a cross-sectional view showing the lift generation plate.

As shown in FIG. 9, "x" marks 53L, 53L are placed in locations set at a distance Δ to the left from the left bolt holes 53, 53, and "x" marks 54L, 54L are placed in locations set at a distance Δ to the left from the right bolt holes 54, 54. Also, "x" marks 53R, 53R are placed in locations set at a distance Δ to the right from the left bolt holes 53, 53, and "x" marks 54R, 54R are placed in locations set at a distance Δ to the right from the right bolt holes 54, 54.

The locations in which the bolt holes 53, 54 and the "x" marks 53L, 53R, 54L, 54R are placed are preferably locations in which the thickness of the lift generation plate 16 is greater than in other locations in order to assure strength.

Figure 11:
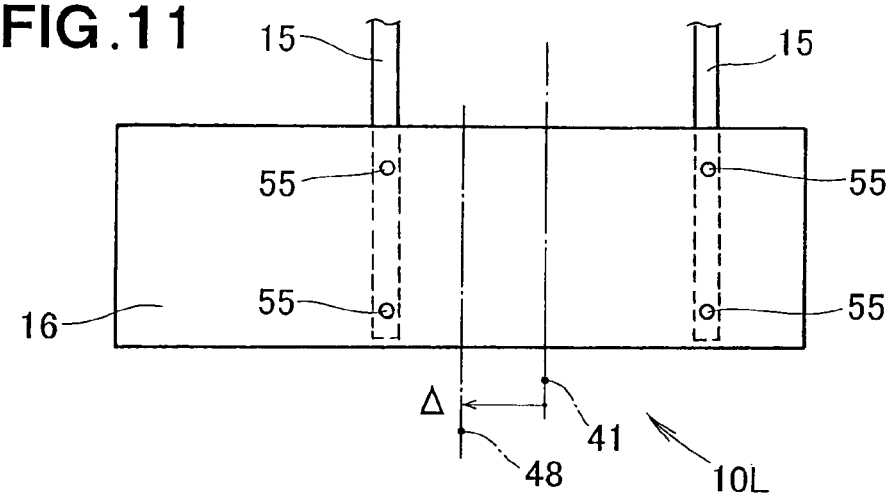
FIG. 11 is a schematic view showing the arrangement of the lift generation plate which is offset to the left.

A description of the case in which the "x" marks 53R, 54R are selected and new bolt holes are opened is described next. The lift generation plate 16 is fastened to the stays 15, 15 using new bolt holes 55, 55, as shown in FIG. 11, and a marine propulsion apparatus 10L that is offset to the left from the center line 41 by a distance Δ is obtained.

Figure 12:
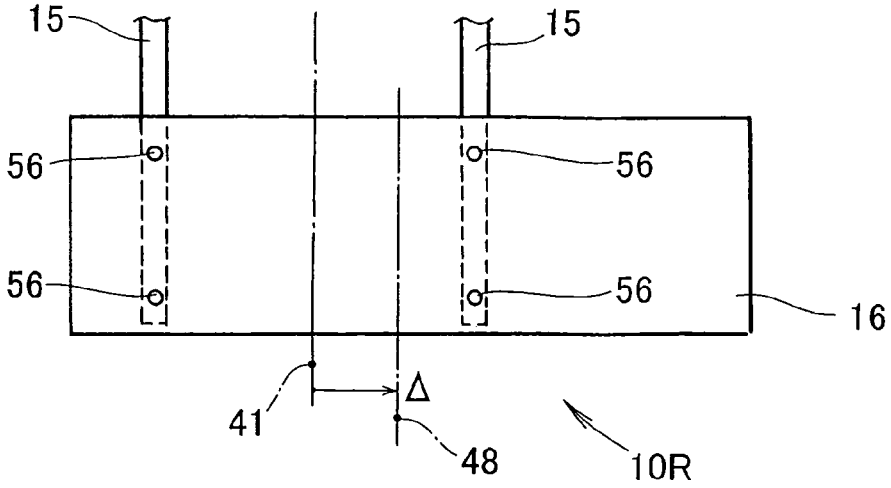
FIG. 12 is a view showing the arrangement of the lift generation plate which has been offset to the right.

A description of the case in which the "x" marks 53L, 54L are selected and new bolt holes are opened is described next. The lift generation plate 16 is fastened to the stays 15, 15 using new bolt holes 56, 56, as shown in FIG. 12, and a marine propulsion apparatus 10R that is offset to the right from the center line 41 by a distance Δ is obtained.

Figure 13:
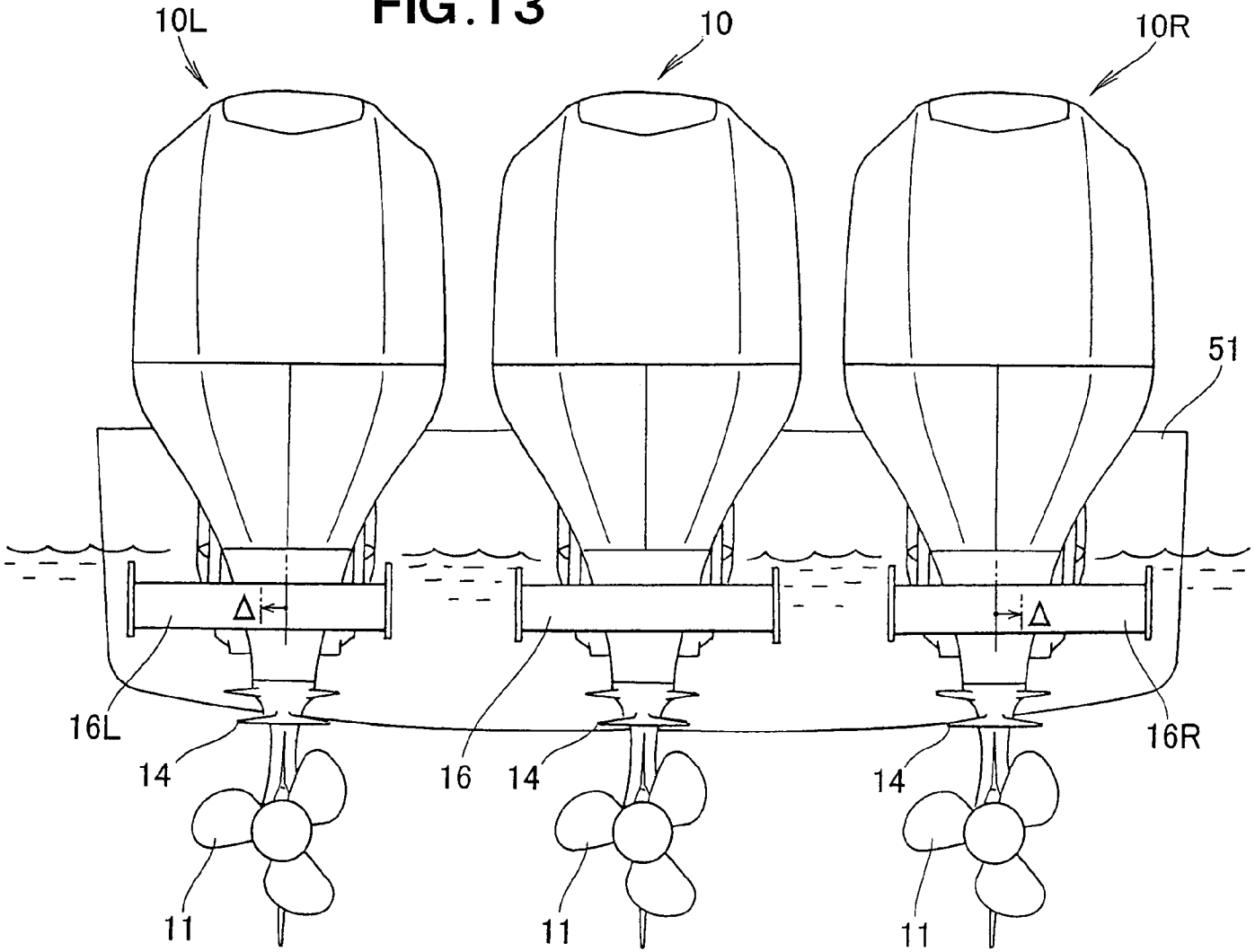
FIG. 13 is a schematic view showing the arrangement of three marine propulsion apparatuses.

The stern 51 can thereby be provided with a marine propulsion apparatus 10L having a lift generation plate 16 that is offset to the left by a distance Δ, a marine propulsion apparatus 10 having a lift generation plate 16 that is not offset, and a marine propulsion apparatus 10R having a lift generation plate 16 that is offset to the right by a distance Δ, as shown in FIG. 13.

There is no concern that the lift generation plates 16L, 16, 16R will interfere with each other even if the three marine propulsion apparatuses 10L, 10, 10R are turned.

Lift is proportional to the surface area (length L×width W) of the lift generation plate 16, as described with reference to FIG. 4. Interference in a plural-engine mode imposes limitations on the length L shown in FIG. 3. The structure described below is preferred when lift obtained using a limited length L is insufficient.

Figure 14:
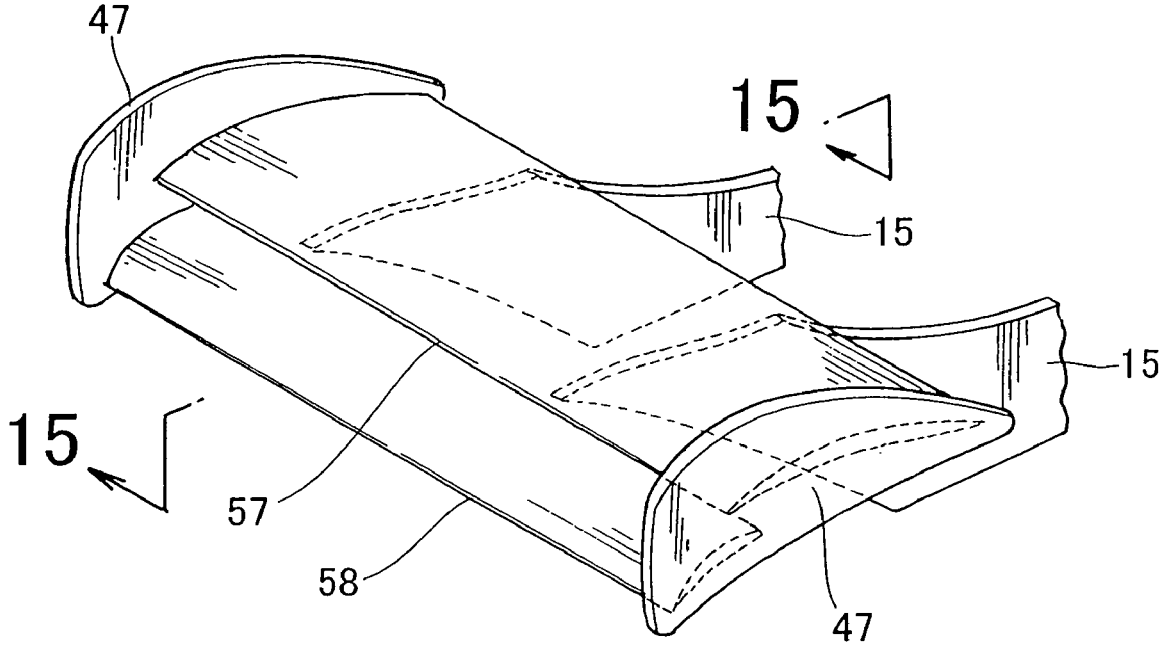
FIG. 14 is a schematic view showing the arrangement of two lift generation plates.
Figure 15:
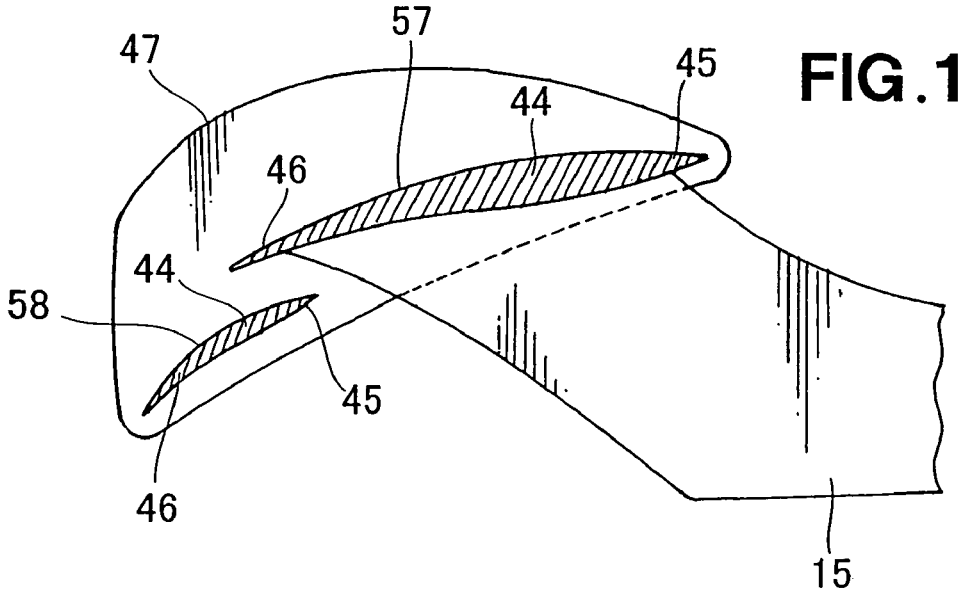
FIG. 15 is a cross-sectional view taken along line 15-15 of FIG. 14.

In other words, a first lift generation plate 57 is disposed in the manner shown in FIG. 14, and in FIG. 15, which is a cross-sectional view along the line 15-15 of FIG. 14, and a second lift generation plate 58 is disposed rearward and below the first lift generation plate 57.

The first lift generation plate 57 has a main wing shape in which the center section 44 is thick, the front part 45 and rear section 46 gradually become thinner, the front part 45 is above, and the rear section 46 is lower. However, the rear section 46 is thinner than the front part 45. The lower surface of the first lift generation plate 57 having such a shape is coupled to the stays 15. The second lift generation plate 58 is a smaller wing-shaped body than the first lift generation plate 57. The center section 44 is thick, the front part 45 and rear section 46 gradually become thinner, the front part 45 is above, and the rear section 46 is lower. The second lift generation plate 58 having such a shape is supported at the two ends by the left and right wing tip plates 47, 47 that are provided to the two ends of the first lift generation plate 57. In other words, the wing tip plate 47 acts to block flow that moves around from the lower surface to the upper surface at the tip sections of the first and second lift generation plates 57, 58, and also acts to support the second lift generation plate 58. The stays 15 are not required to extend to the second lift generation plate 58 and can therefore be made smaller.

The first and second lift generation plates 57, 58 both generate lift when the first and second lift generation plates 57, 58 move through the water. In other words, lift is produced that is proportional to the combined surface areas of the first lift generation plate 57 and the second lift generation plate 58.

The first and second lift generation plates 57, 58 move upward under considerable lift, but the first lift generation plate 57 leaves the surface of the water first. At this time, the second lift generation plate 58 is still submerged in the water and therefore continues to generate lift.

In the working example described above, a first lift generation plate 57 having a large surface area and a second lift generation plate 58 having a small surface area were used in combination, but similarly shaped first and second lift generation plates 57, 58 may also used in combination. An example of such a configuration will be described next.

Figure 16:
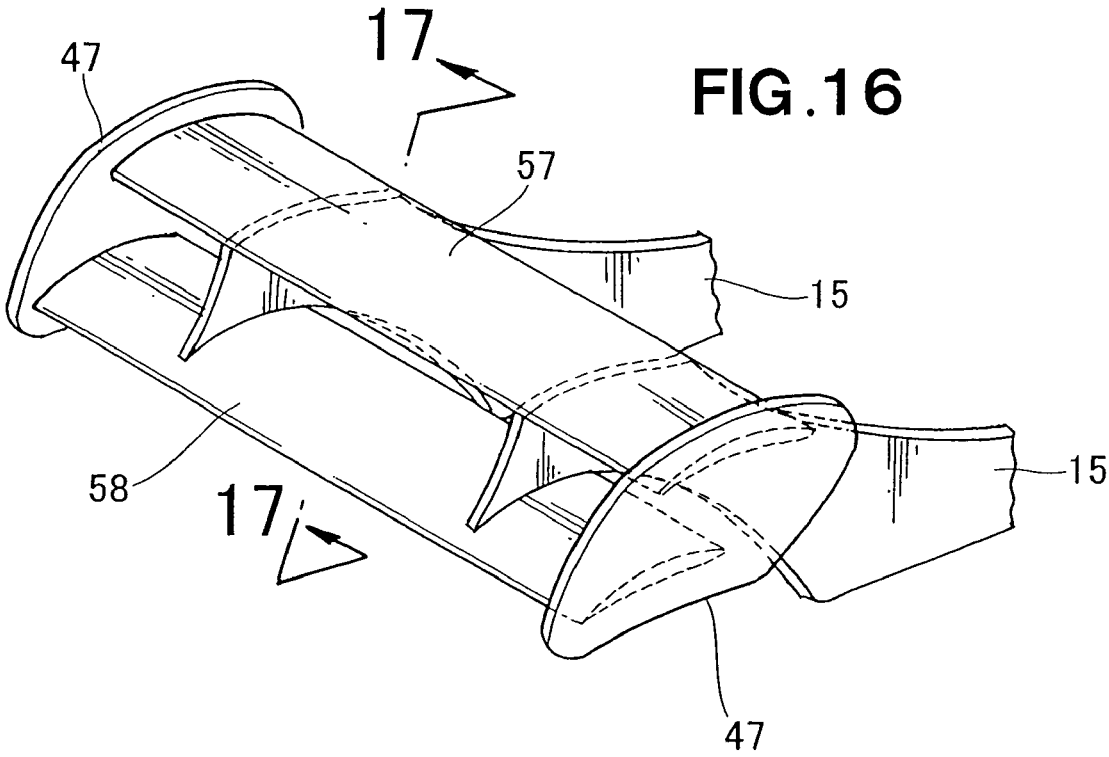
FIG. 16 is a view showing the arrangement of two lift generation plates.
Figure 17:
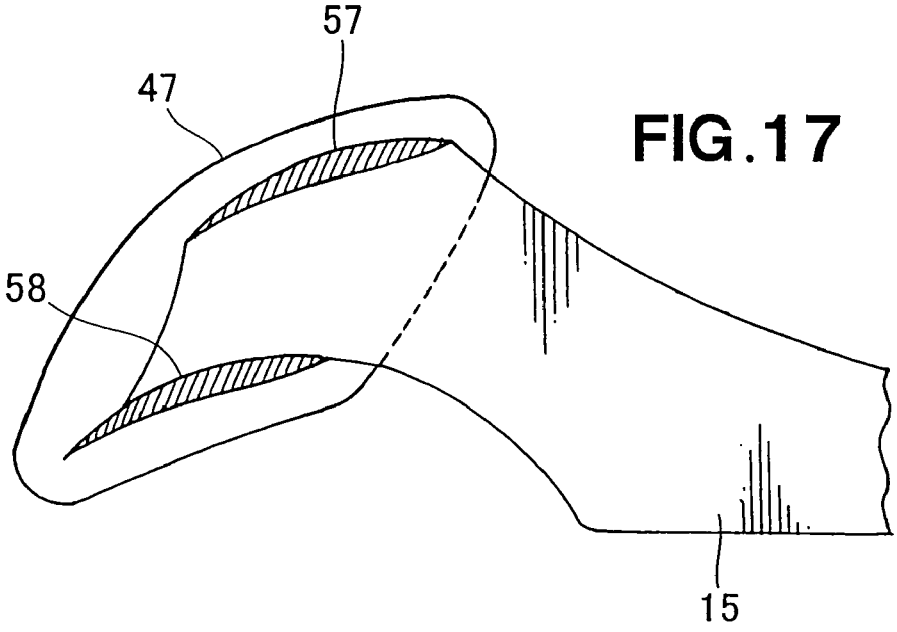
FIG. 17 is a cross-sectional view taken along line 17-17 of FIG. 16.

A first lift generation plate 57 is disposed in the manner shown in FIG. 16 and in FIG. 17, which is a cross-sectional view along the line 17-17 of FIG. 16; and a second lift generation plate 58 has the same shape as the first lift generation plate 57 and is disposed below the first lift generation plate 57.

The first lift generation plate 57 and the second lift generation plate 58 are supported by the stays 15. The two ends of the first and second lift generation plates 57, 58 are both connected by the left and right wing tip plates 47 an 47. The first and second lift generation plates 57, 58 have the same shape and are disposed in a substantially vertical relationship, and the wing tip plate 47 is a small rhombus-shaped plate.

The first and second lift generation plates 57, 58 both generate lift when the first and second lift generation plates 57, 58 move through the water. In other words, lift is produced that is proportional to the combined surface areas of the first lift generation plate 57 and the second lift generation plate 58. The first and second lift generation plates 57, 58 move upward under considerable lift, but the first lift generation plate 57 leaves the surface of the water first. At this time, the second lift generation plate 58 is still submerged in the water and therefore continues to generate lift.

In the example above, a portion of the second lift generation plate 58 is superimposed on the first lift generation plate 57 as viewed from above. However, the first and second lift generation plates 57, 58 may be completely separated is the forward/rearward direction, and an example of this configuration will be described next.

Figure 18:
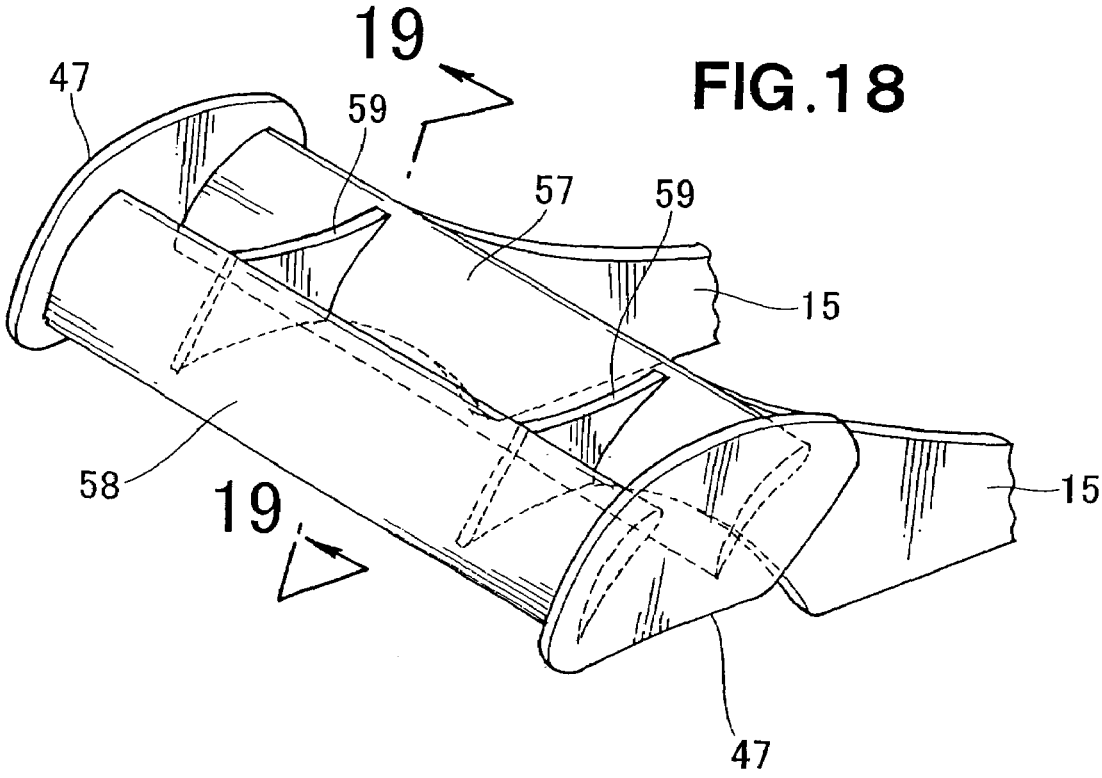
FIG. 18 is a schematic view showing the arrangement of two lift generation plates.
Figure 19:
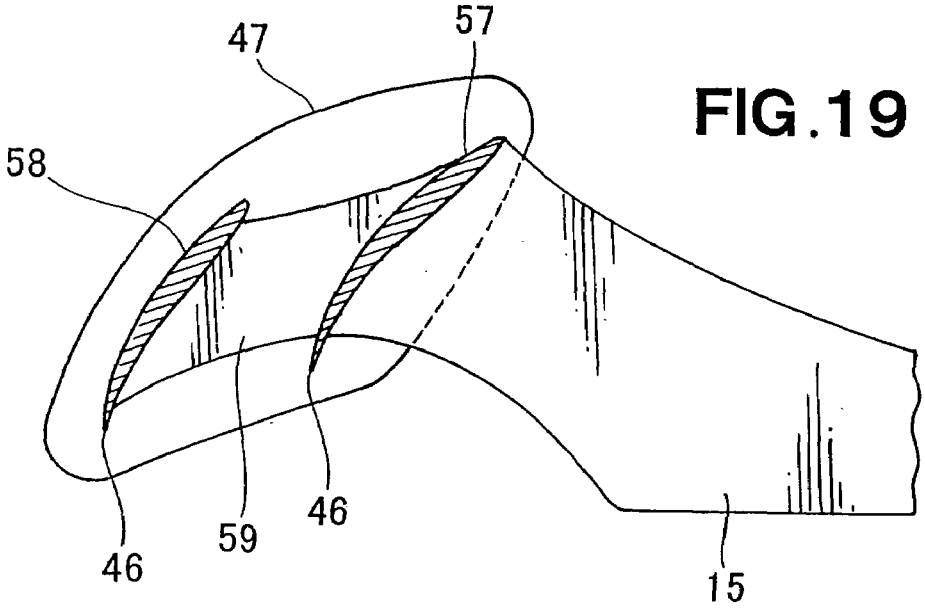
FIG. 19 is a cross-sectional view taken along line 19-19 of FIG. 18.

The first lift generation plate 57 is fastened to the stays 15 in the manner shown in FIG. 18 and in FIG. 19, which is a cross-sectional view along the line 19-19 of FIG. 18. A sub-stay 59 extends from the first lift generation plate 57, and the second lift generation plate 58 is fastened to the sub-stay 59. In other words, the second lift generation plate 58 is disposed rearward of the first lift generation plate 57 and in a position that is set at a distance so as to not be superimposed on the first lift generation plate 57 as viewed from above.

The first and second lift generation plates 57, 58 both generate lift when the first and second lift generation plates 57, 58 move through the water. In other words, lift is produced that is proportional to the combined surface areas of the first lift generation plate 57 and the second lift generation plate 58.

Rearward sections 46, 46 of the first and second lift generation plates 57, 58 are both in a low position, and therefore remain in the water for a long period of time, continuing to produce lift. This configuration is more advantageous than the previous example in which the two lift generation plates are disposed in a vertical relationship. The stern can be rapidly lifted in locations having a shallow water line.

The case of two lift generation plates was described above, but three or more lift generation plates are also possible. Therefore, an example of three lift generation plates will be described next.

The stays 15 have a notched triangular section 61 indicated by an imaginary line in FIG. 21, and the first lift generation plate 57 rests on the resulting terrace 62 in the manner shown in FIG. 20 and in FIG. 21, which is a cross-sectional view along the line 21-21 of FIG. 20. In other words, the first lift generation plate 57 is fastened to the stays 15 while allowed to rest on the terrace 62. The second lift generation plate 58 is disposed rearward and above the first lift generation plate 57, and a third lift generation plate 63 is disposed rearward and below the first lift generation plate 57. The second lift generation plate 58 is fastened to the upper edge of the rear end of the stays 15, which is rearward from the terrace 62, and the third lift generation plate 63 is fastened to the lower edge of the rear end of the stays 15.

In this manner, the first to third lift generation plates 57, 58, 63 are fastened to the stays 15.

The first lift generation plate 57 is shaped as a main wing that has a large cross section, as shown in the Figure, and the second and third lift generation plates 58, 63 are provided with a wing section having a small cross section.

The first to third lift generation plates 57, 58, 63 generate lift together when the first to third lift generation plates 57, 58, 63 move through the water. In other words, lift is produced that is proportional to the combined surface areas of the first to third lift generation plates 57, 58, 63.

The second lift generation plate 58 leaves the surface of the water first as the stern rises, and the first lift generation plate 57 and third lift generation plate 63 continue to generate lift. When the stern rises further, the first lift generation plate 57 leaves the surface of the water and the third lift generation plate 63 continues to generate lift.

Therefore, greater lift is obtained by using three lift generation plates, and lift can be generated over a long period of time.

Figure 22:
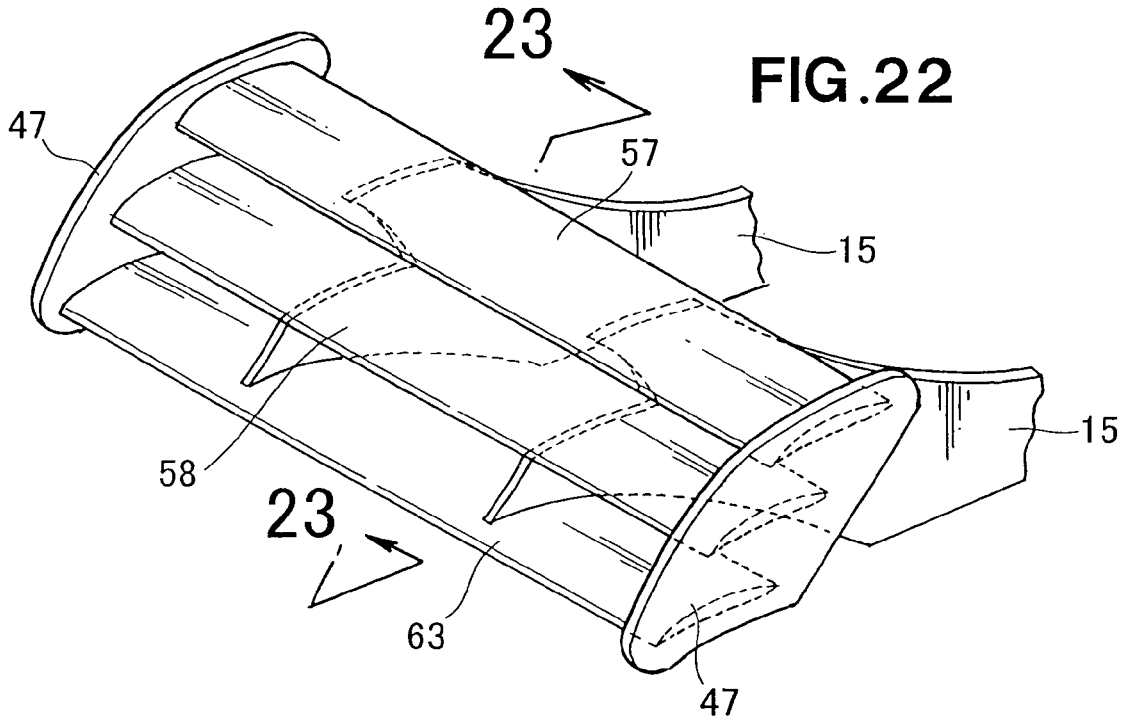
FIG. 22 is a schematic view showing the arrangement of three lift generation plates.
Figure 23:
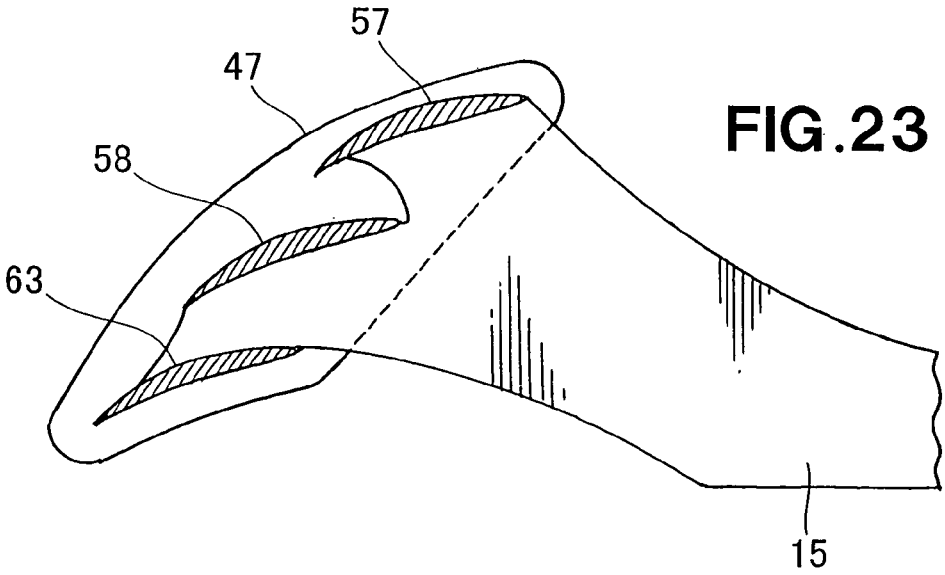
FIG. 23 is a cross-sectional view taken along line 23-23 of FIG. 22.

The second lift generation plate 58 is disposed rearward and below the first lift generation plate 57 as shown in FIG. 22 and in FIG. 23, which is a cross-sectional view along the line 23-23 of FIG. 22. The third lift generation plate 63 is disposed rearward and below the second lift generation plate 58, and the first to third lift generation plates 57, 58, 63 can be supported by the stays 15. In this example, the first to third lift generation plates 57, 58, 63 can have the same shape.

The first to third lift generation plates 57, 58, 63 generate lift together when the first to third lift generation plates 57, 58, 63 move through the water. In other words, considerable lift is can be obtained that is proportional to the combined surface areas of the first to third lift generation plates 57, 58, 63.

The first lift generation plate 57 leaves the surface of the water first as the stern rises, and the second lift generation plate 58 and third lift generation plate 63 continue to generate lift. When the stern rises further, the second lift generation plate 58 leaves the surface of the water and the third lift generation plate 63 continues to generate lift.

Therefore, greater lift is obtained by using three lift generation plates, and lift can be generated over a long period of time.

The lift generation plates having a main wing shape and the smaller wing shapes described above are ideal for fluid dynamics, but are more expensive to manufacture. Therefore, a low-cost, flat plate-shaped lift generation plate will be considered.

Figure 24:
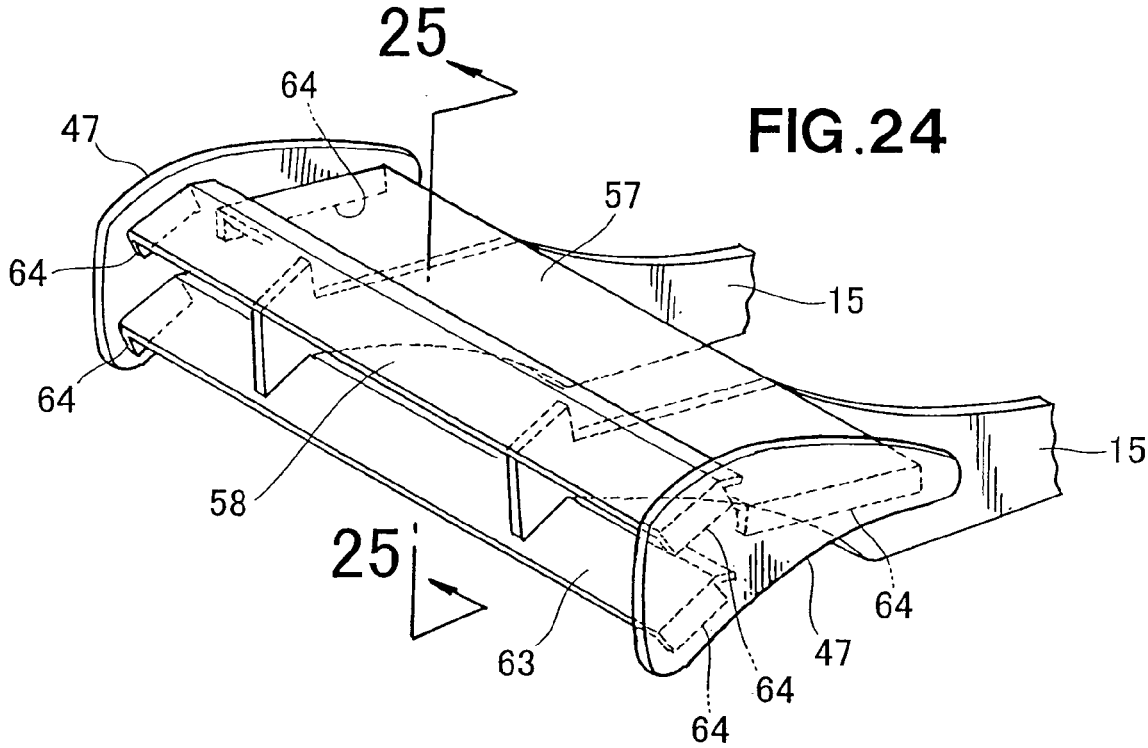
FIG. 24 is a schematic view showing the arrangement of three lift generation plates.
Figure 25:
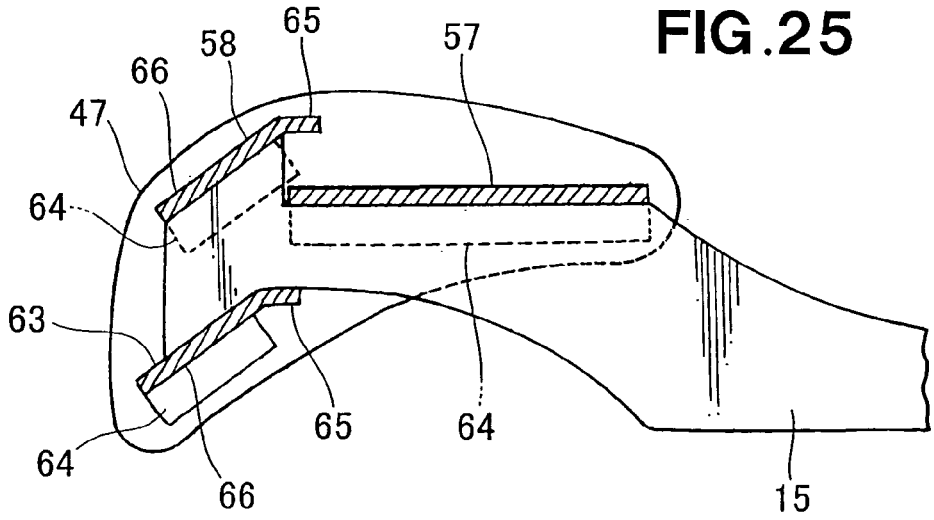
FIG. 25 is a cross-sectional view taken along line 25-25 of FIG. 24.

The first to third lift generation plates 57, 58, 63 can be shaped as flat plates in the manner shown in FIG. 24 and in FIG. 25, which is a cross-sectional view taken along line 25-25 of FIG. 24. The large first lift generation plate 57 has a belt-shaped edge part 64 that is formed by bending the left and right tip sections to L. The result is that the contact surface area with the wing tip plate 47, which is a flat plate, is reduced and it is difficult to increase the bonding strength. In view of this fact, the contact surface area can be increased and the bonding strength with the wing tip plate 47 can be sufficiently enhanced by using the belt-shaped edge part 64.

The second and third lift generation plates 58, 63 have horizontal sections 65 at the front edge, and water can smoothly flow to the trailing sloped section 66. The second and third lift generation plates 58, 63 have the belt-shaped edge parts 64 that are formed by bending the left and right tip sections to L.

The belt-shaped edge parts 64 can easily be formed by bending if as the material is a metal. A cavity having a simple shape can be formed if the material is a resin.

A flat plate is inexpensive to manufacture but has drawbacks in that the loss of flow is higher and the resulting anticipated lift is reduced. The structure is provided that can reduce the loss of flow.

Figure 26:
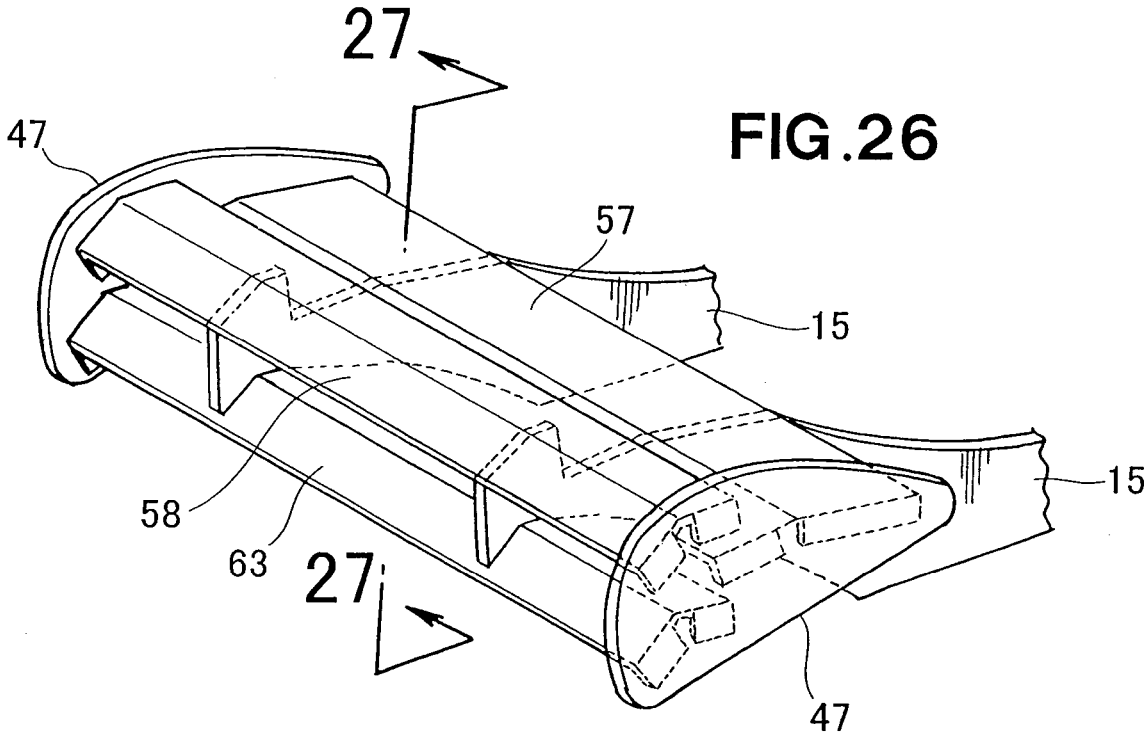
FIG. 26 is a schematic view showing the arrangement of three lift generation plates.
Figure 27:
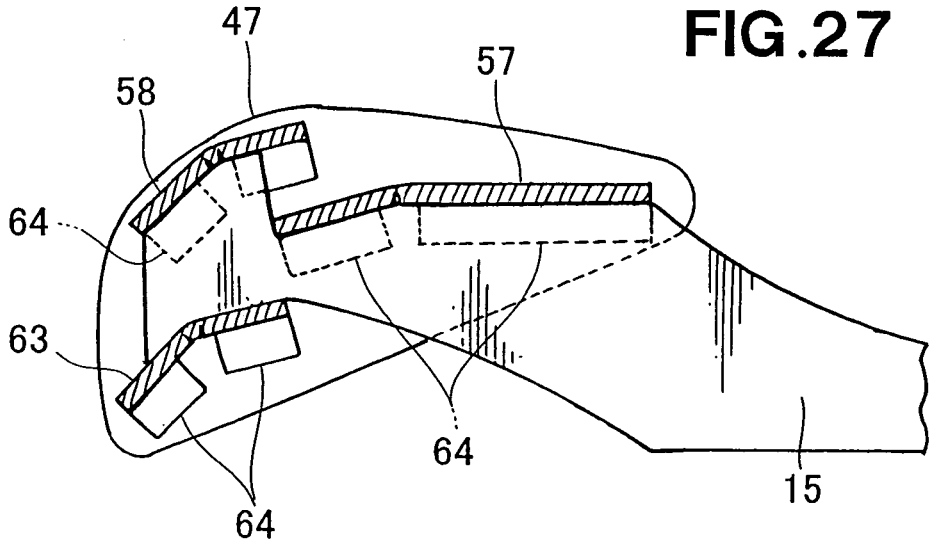
FIG. 27 is a cross-sectional view taken along line 27-27 of FIG. 26.

The first to third lift generation plates 57, 58, 63 can be shaped as flat plates in the manner shown in FIG. 26 and in FIG. 27, which is a cross-sectional view along the line 27-27 of FIG. 26. The first lift generation plate 57 is bent so as to form a V shape. A wing structure can be approximated, the loss of flow can be reduced more than with a simple flat plate, and a reduction in lift force can be avoided by using an inverted V section. Bending can be smoothly carried out by setting the belt-shaped edge part at a distance in front and behind. The same applies to the second and third lift generation plates 58, 63.

Figure 28:
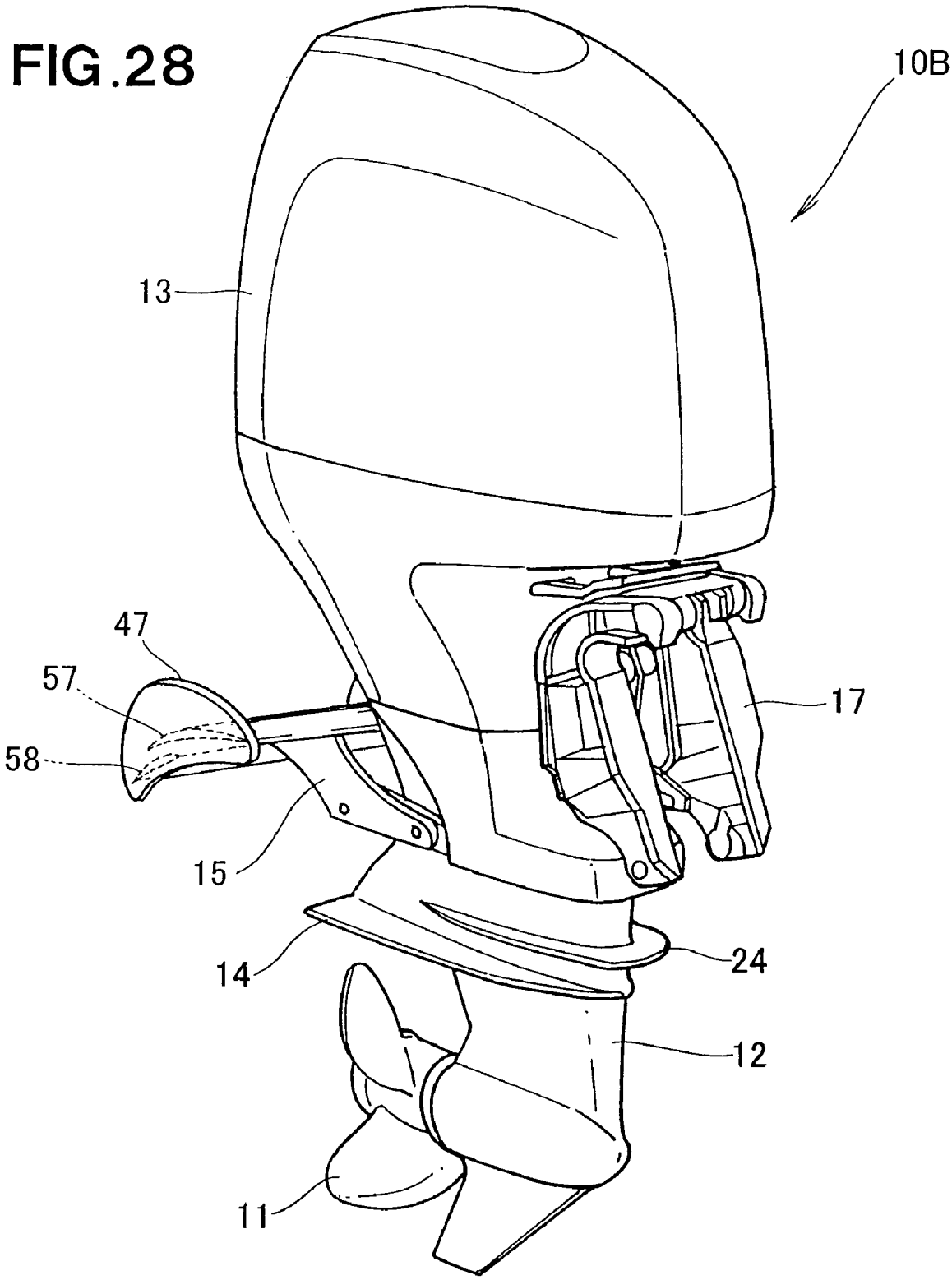
FIG. 28 is a perspective view of the marine propulsion apparatus provided with three lift generation plates.

The marine propulsion apparatus 10B shown in FIG. 28 is provided by mounting the plurality of lift generation plates described above.

The marine propulsion apparatus 10B is composed of a casing 12 for supporting a propeller 11 that propels the hull, a cover 13 that extends upward from the upper end of the casing 12 and covers the engine that drives the propeller 11, an anti-cavitation plate 14 that extends in the left/right direction from the casing 12 and reduces the cavitation phenomenon that is generated together with the rotation of the propeller, a stay 15 that extends rearward from the casing 12 in a position above the anti-cavitation plate 14, and a plurality of lift generation plates 57, 58 that is supported by the stays 15, extends in the width direction of the hull above the anti-cavitation plate 14 and rearward of the casing 12, and generates lift during propulsion.

Figure 3:
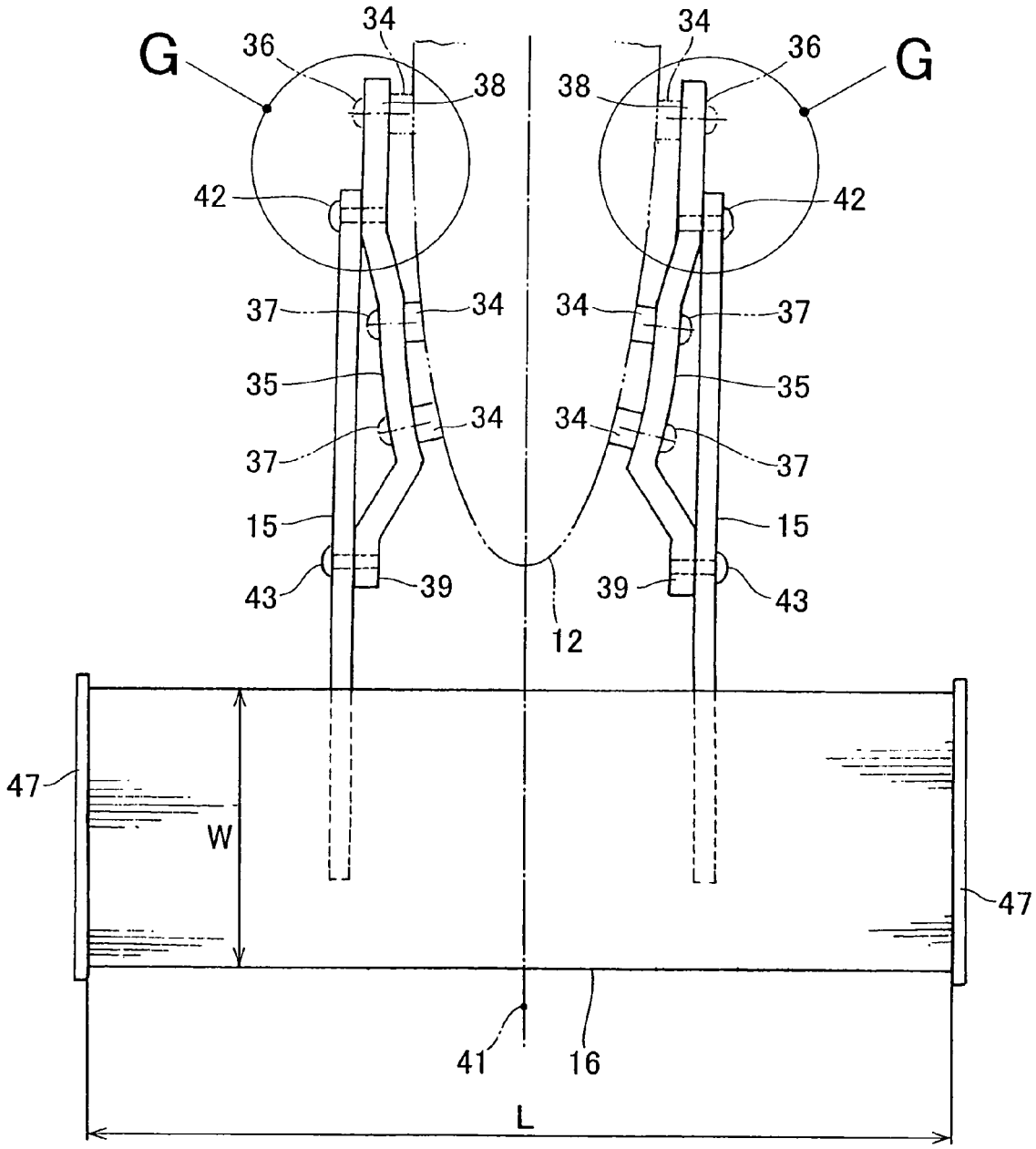
FIG. 3 is cross-sectional view taken along line 3 of FIG. 2.

The front part 38 of a relay plate 35 is mounted on the casing 12 using bolts 36, and the stays 15 are mounted on the front part 38 of the relay plate 35 using bolts 42, as shown in FIG. 3. When the casing 12 is viewed diagonally from the rear, the appearance of the relay plate 35 is made worse because the bolts 42 and the like can be seen. In other words, the large majority of the relay plate 35 is located on the inner side of the stays 15 and is hidden by the stays 15, but this portion is a particular problem because the front part 38 and the head of the bolts 38 are exposed. Therefore, a structure is provided in which the external appearance of the G part of FIG. 3 can be improved.

Figure 29:
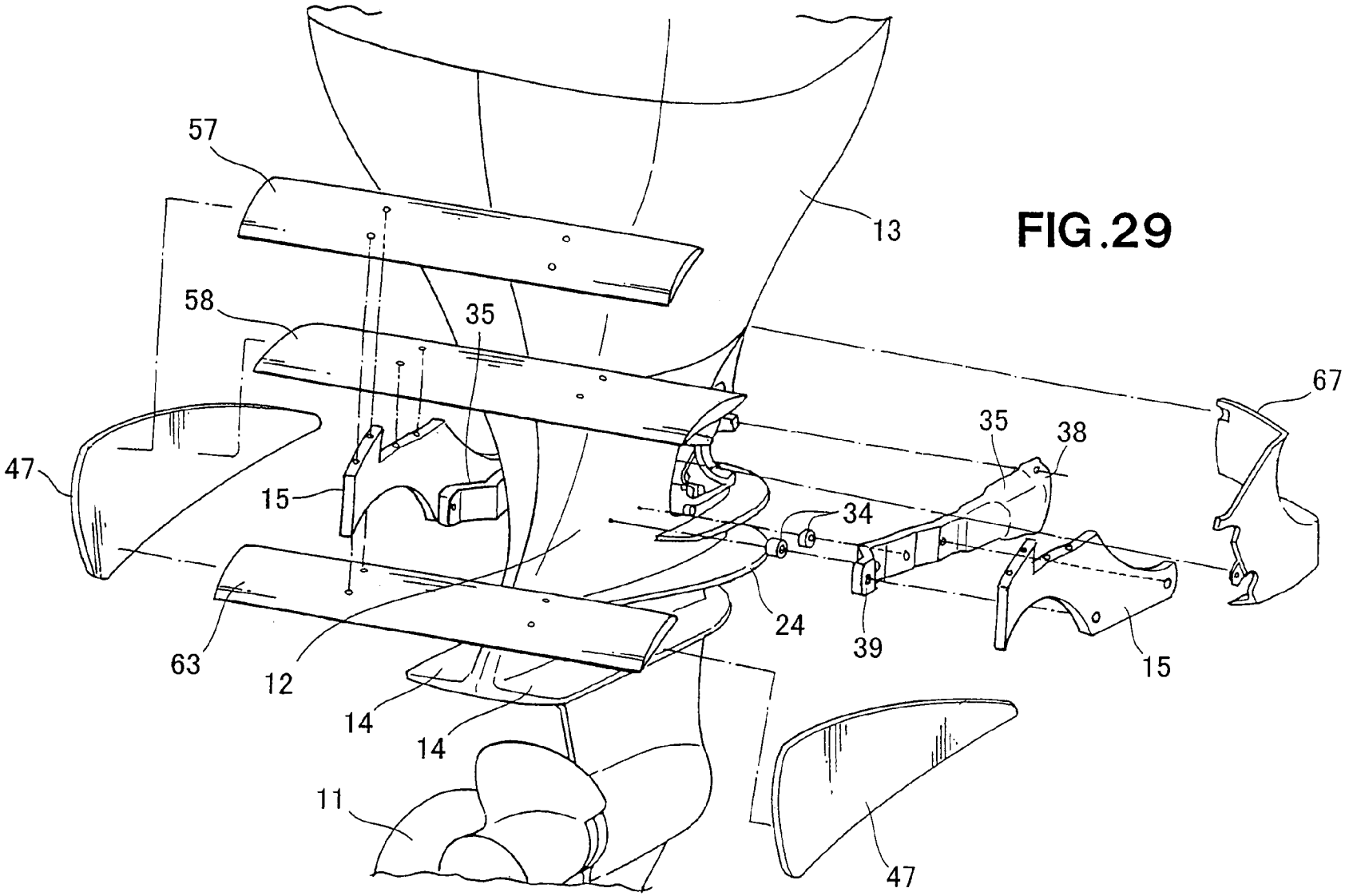
FIG. 29 is an exploded perspective view showing a mode of the stay and the decorative cover.
Figure 30:
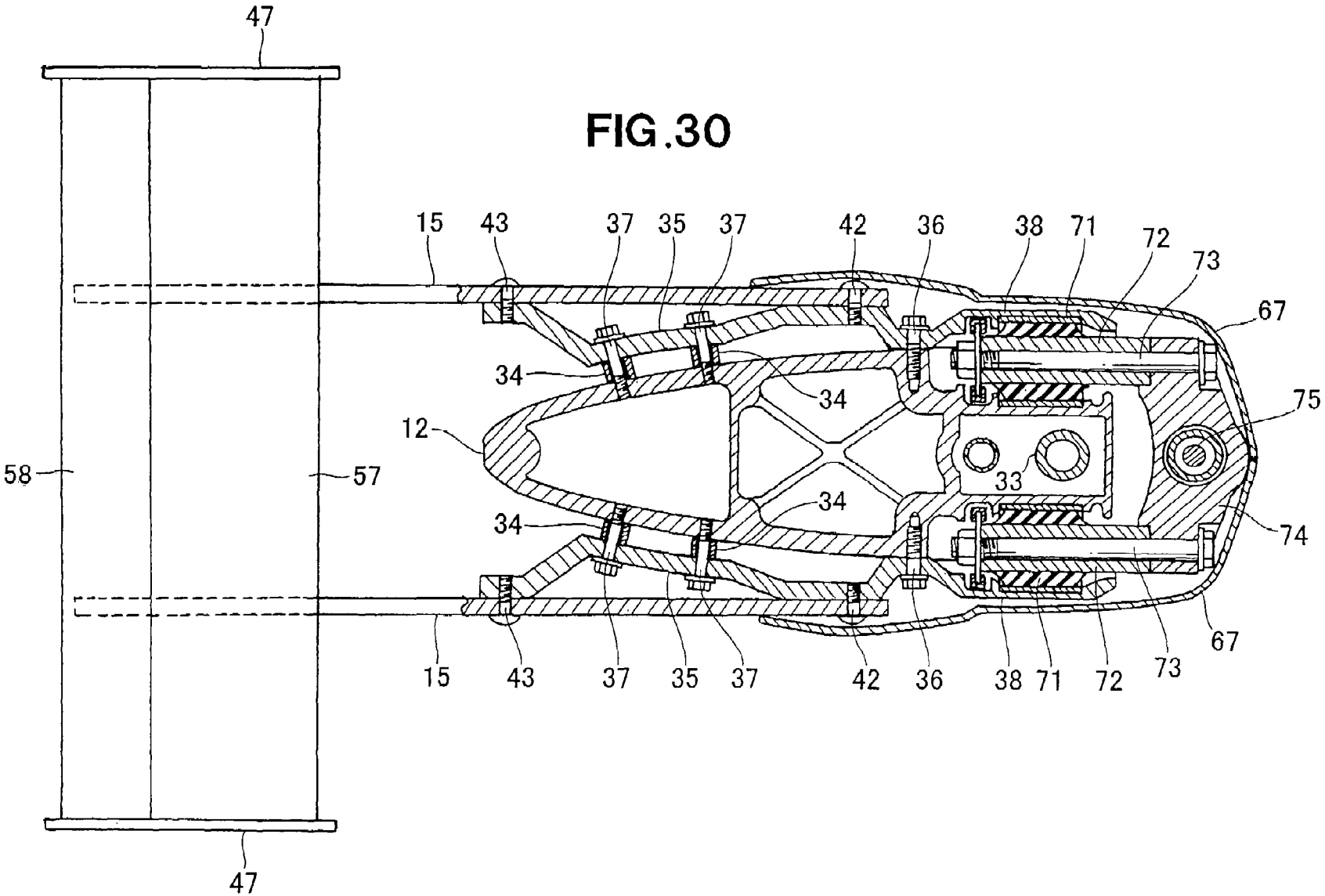
FIG. 30 is a cross-sectional view of the marine propulsion apparatus, showing the stay and the decorative cover.

A decorative cover 67 is added in the manner shown in FIG. 29. In other words, the relay plate 35 is made to face the casing 12, the decorative cover 67 is made to face the front part 38 of the relay plate 35, the stays 15 are made to face the rear section 39 of the relay plate 35, the lift generation plates 57, 58, 63 are made to face the rear section of the stays 15, and the wing tip plates 47, 47 are made to face in the left/right direction of the first to third lift generation plates 57, 58, 63. A plane cross section of the assembled components will be described with reference to FIG. 30.

The casing 12 is supported by rubber mounts 71, long collars 72, long bolts 73, and a swivel casing 74, as shown in FIG. 3. The swivel casing 74 can rotate about a swivel shaft 75. The drive shaft 32 is accommodated in the casing 12.

The rubber mounts 71 are fitted onto the front portion of the casing 12 and are thereafter pressed by the front part 38 of the relay plate 35. In other words, the collar 34 is placed in contact with the casing 12, and the relay plate 35 is made to conform to the collar 34. Next, the relay plate 35 is fastened to the casing 12 using bolts 36, 37, 37. In this case, the rubber mounts 71 are pressed by the front part 38 of the relay plate 35. An increase in the number of components can be prevented because a dedicated lid for pressing the rubber mounts 71 is not required in the front part 38 of the relay plate 35.

The stays 15 are placed in contact with the relay plate 35 and connected using bolts 42, 43. The lift generation plates 57, 58 are mounted on the stays 15.

Next, the distal end of the stays 15 and the bolts 42 are covered by a decorative cover 67. The decorative cover 67 covers the swivel casing 74 and the rubber mounts 71, and the distal end of the stays 15 and the bolts 42 are also covered at the same time. As a result, the G part shown in FIG. 3 is covered by the decorative cover 67, and the external appearance is improved.

Figure 31:
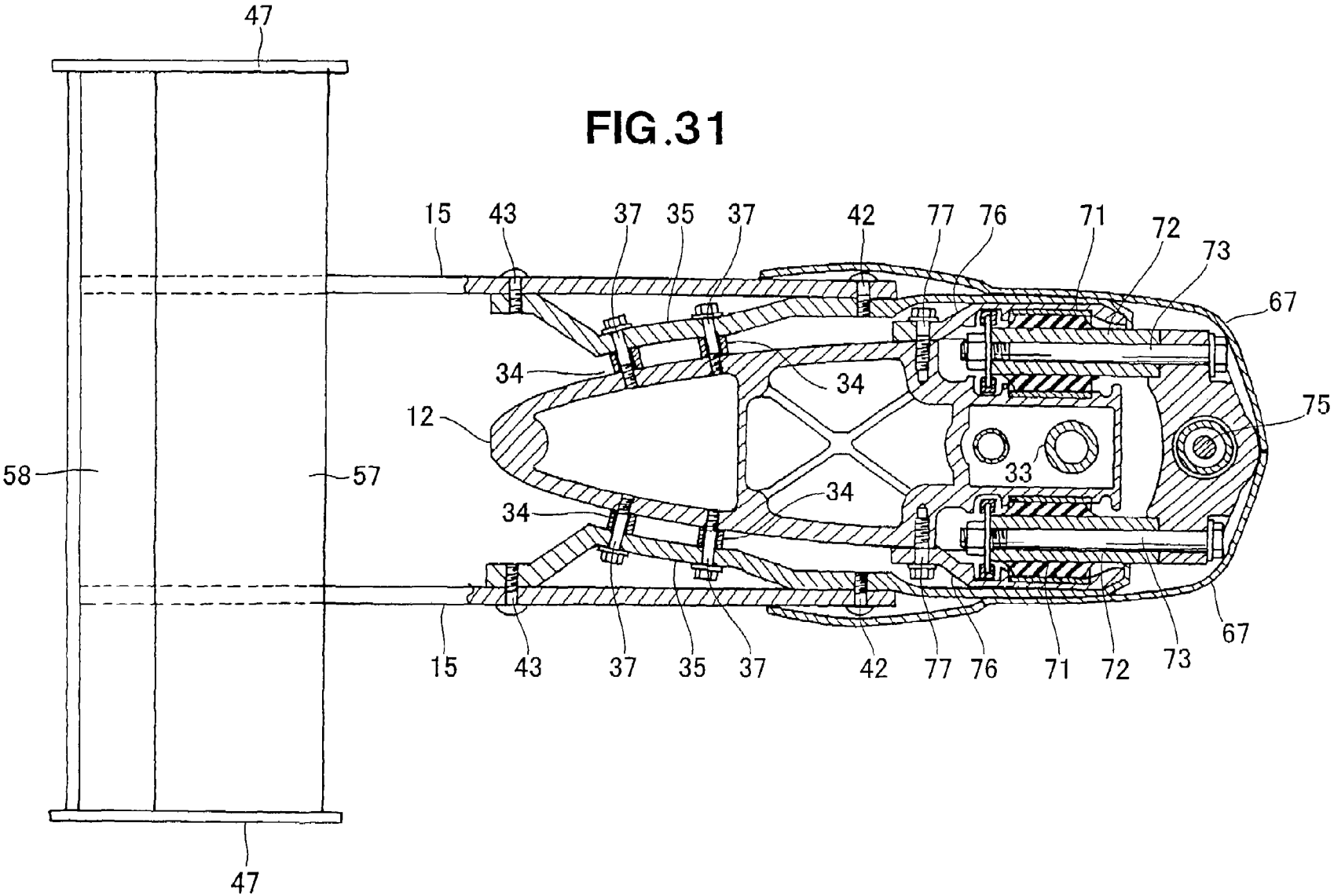
FIG. 31 is a cross-sectional view of the marine propulsion apparatus showing a mode of the stay and the decorative cover.

The structure shown in FIG. 31 is recommended when the rubber mounts 71 are pressed by a dedicated lid. In other words, a dedicated lid 76 is placed in contact with the rubber mounts 71, and the lid 76 is fastened to the casing 12 using bolts 77. The same reference will be used because other components are the same as those in FIG. 30, and a detailed description is omitted.

A load is not placed on the relay plate 35 because the rubber mounts 71 press the lid 76 in the manner shown in FIG. 31. As a result, the front part 38 of the relay plate 35 can be made thinner and more lightweight. In this example as well, the front part 38 of the relay plate 35, the bolts 36, the distal end of the stays 15, and the bolts 42 are covered by the decorative cover 67. The decorative cover 67 covers the swivel casing 74 and the rubber mounts 71, and the distal end of the stays 15 and the bolts 42 are also covered at the same time. As a result, the G part shown in FIG. 3 is covered by the decorative cover 67, and the external appearance is improved.

Figure 32:
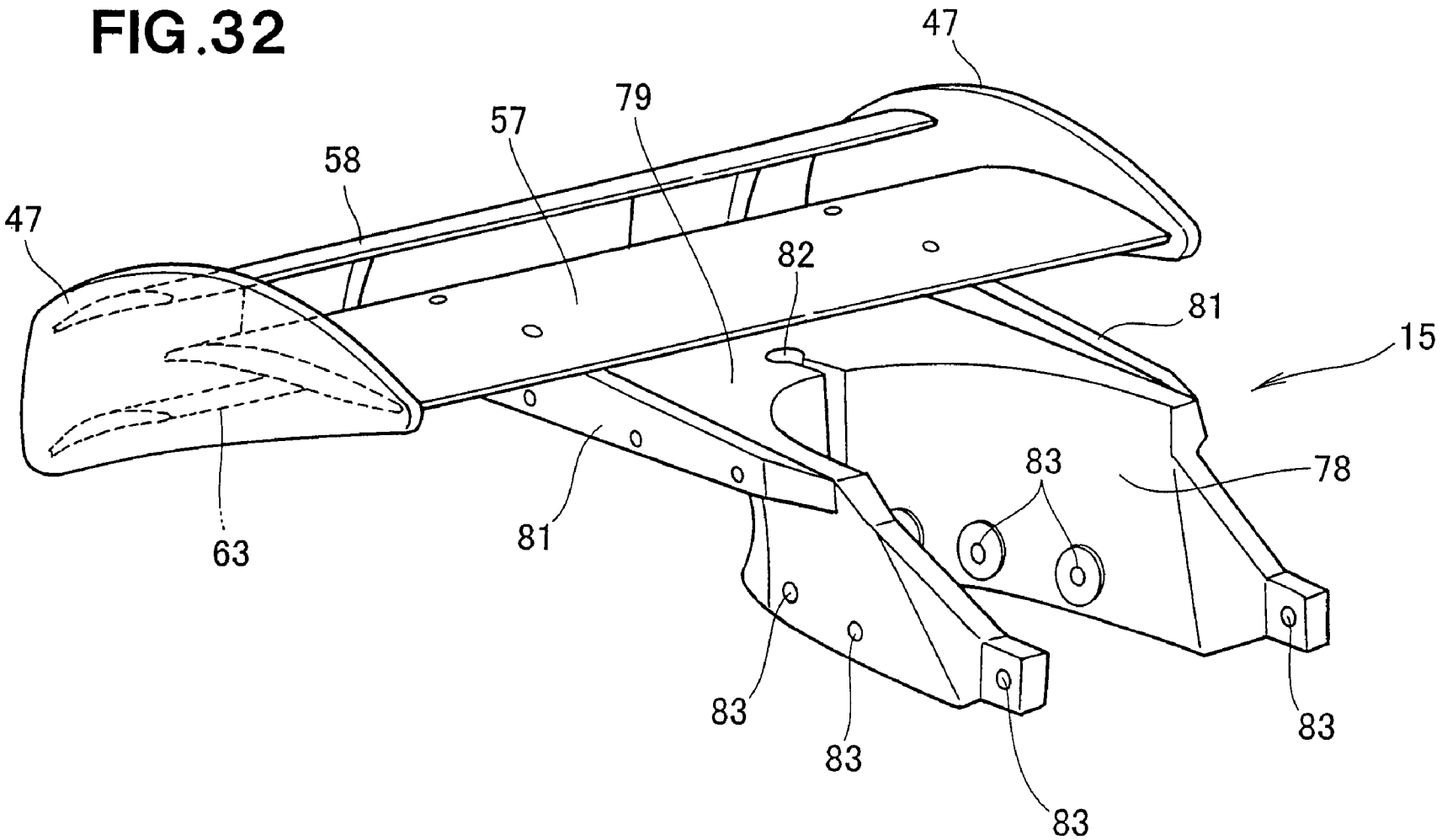
FIG. 32 is a perspective view of a stay having a U-shaped wall part.

The stays 15 shown in FIG. 31 are linear members and their manufacture is simple, but the members have a drawback in that they are not resilient against horizontal force (force that operates in the width direction of the hull). A structure that can withstand horizontal force will be described with reference to FIGS. 32 and 35.

The stay 15 is composed of a U-shaped wall part 78 in which a wall follows a U shape, a terrace part 79 that extends rearward from the upper end of the U-shaped wall part 78, and arm parts 81, 81 that extend rearward from the left and right ends of the terrace part 79.

Figure 33:
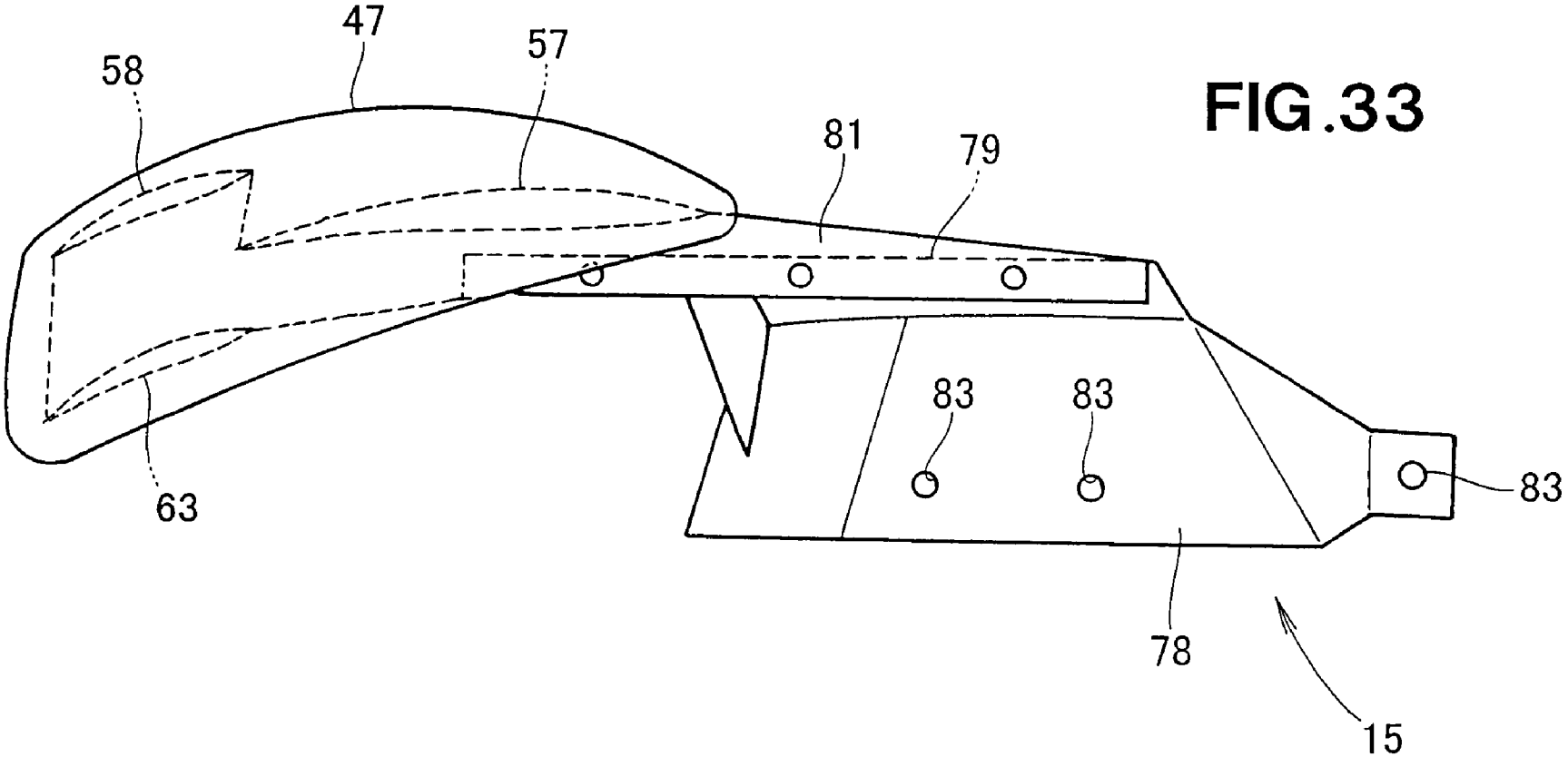
FIG. 33 is a side elevational view of the stay with the U-shaped wall part.

The first to third lift generation plates 57, 58, 63 are disposed on the arm parts 81 in the manner shown in FIG. 33. A plurality of bolt holes 83 is opened in the U-shaped wall part 78.

Figure 34:
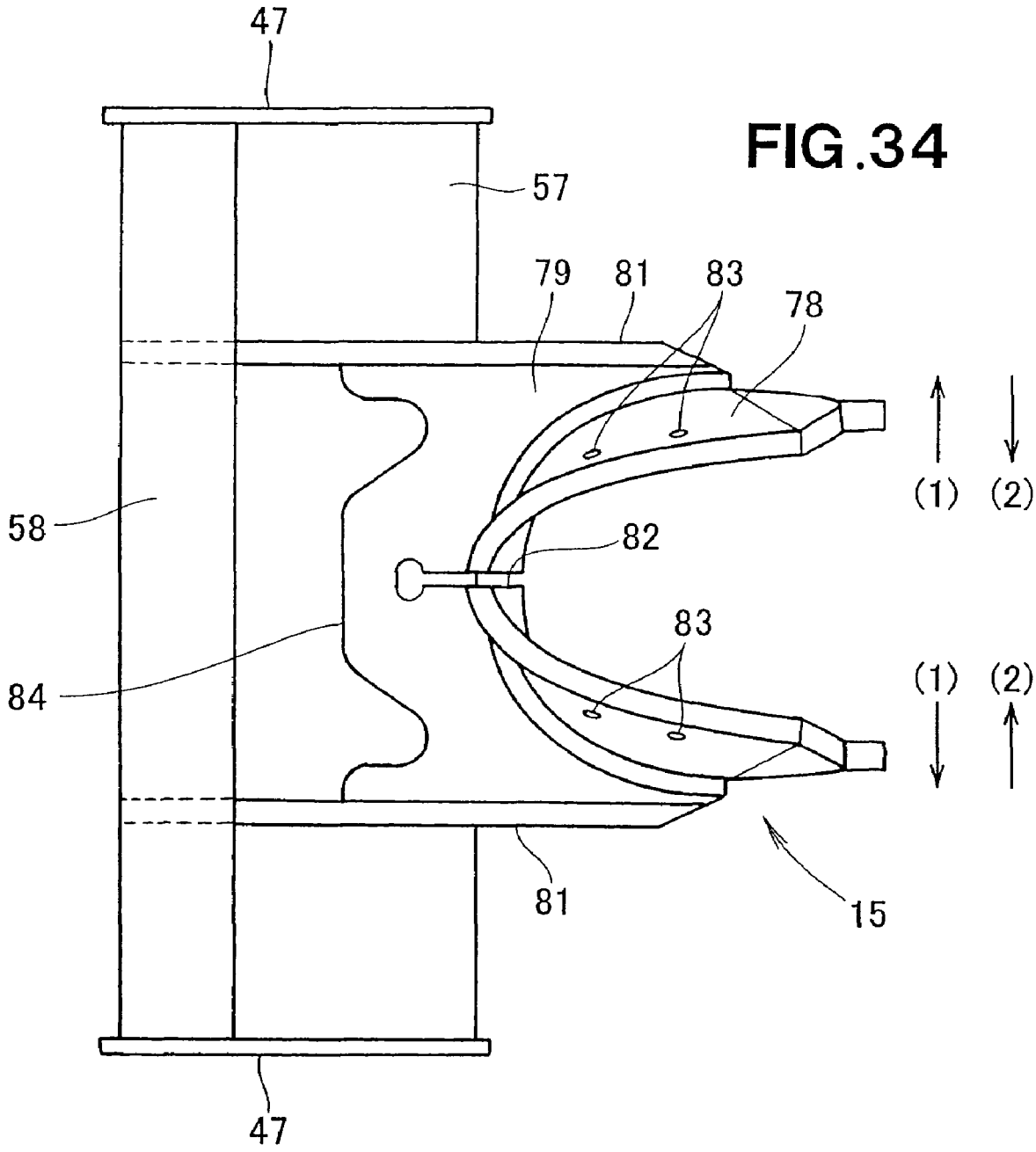
FIG. 34 is a bottom view of the stay with the U-shaped wall part.

A keyhole-shaped notched part 82 is provided from the bottom portion of the U-shaped wall part 78 to the terrace part 79 in the manner shown in FIG. 34, which is a bottom view. When the notched part 82 is provided, the U-shaped wall part 78 can open in the manner indicated by the arrow (1) and close in the manner indicated by the arrow (2). The rear edge 84 of the terrace part 79 is in the center area of the first lift generation plate 57. In other words, the position of the rear edge 84 is determined based on the condition that the water that flows between the terrace part 79 and the first lift generation plate 57 is not obstructed.

Figure 35:
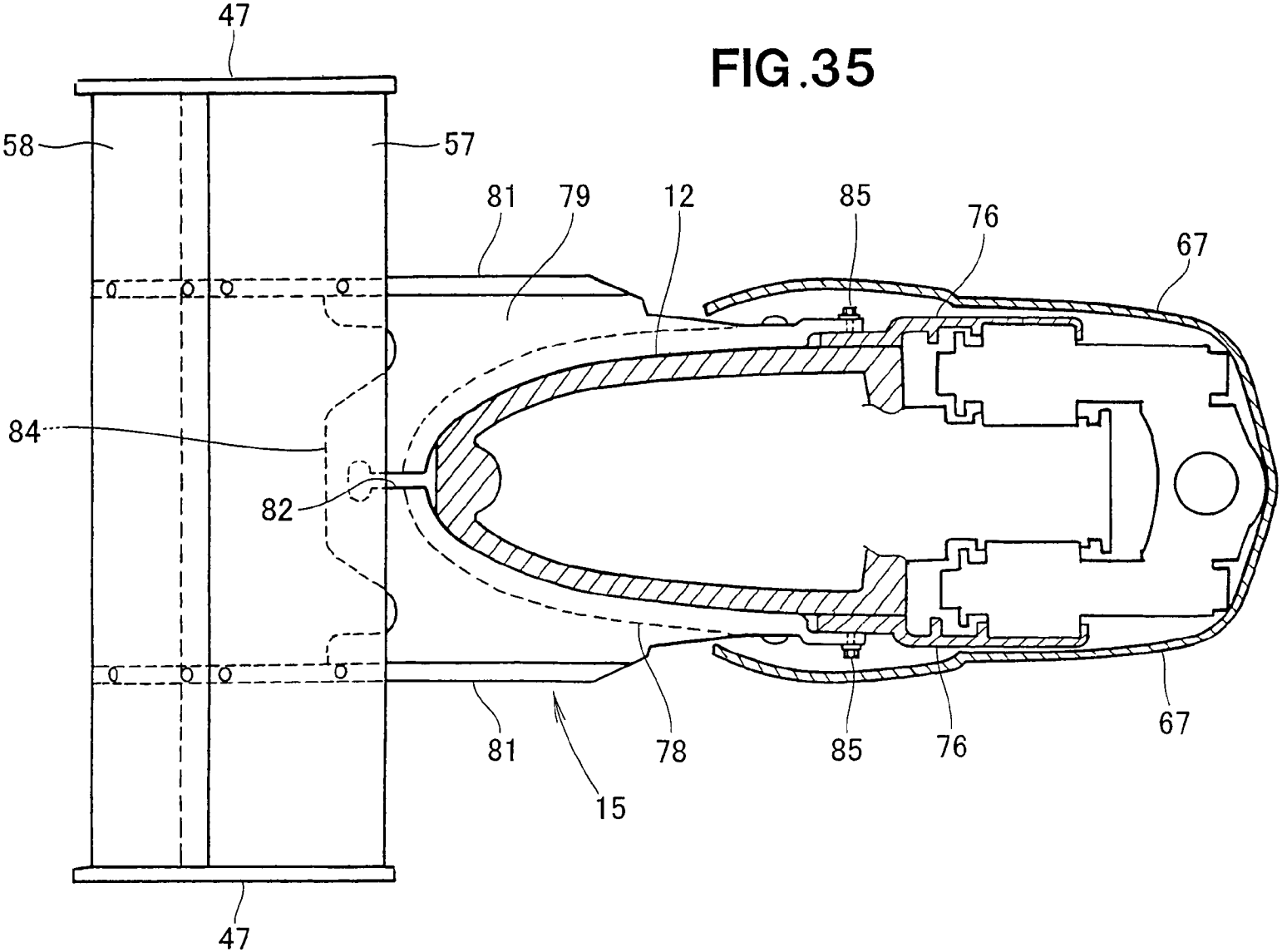
FIG. 35 is a cross-sectional view of the marine propulsion apparatus on which the stay having the U-shaped wall part is mounted.
Figure 36:
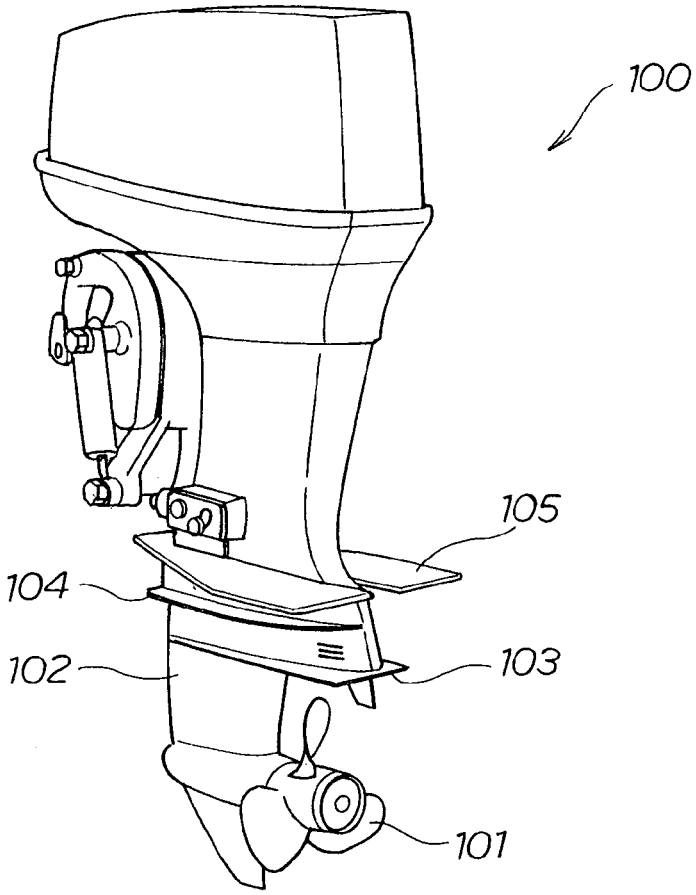
FIG.36 (PRIOR ART)
FIG. 36 is a perspective view showing a conventional marine propulsion apparatus.
Figure 37:
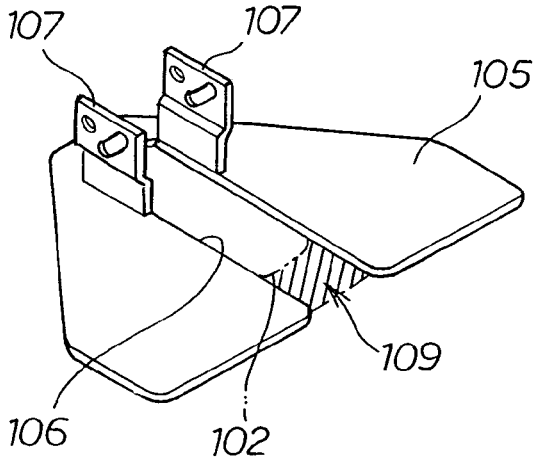
FIG.37 (PRIOR ART)
FIG. 37 is a perspective view of a conventional lift generation plate.
Figure 38:
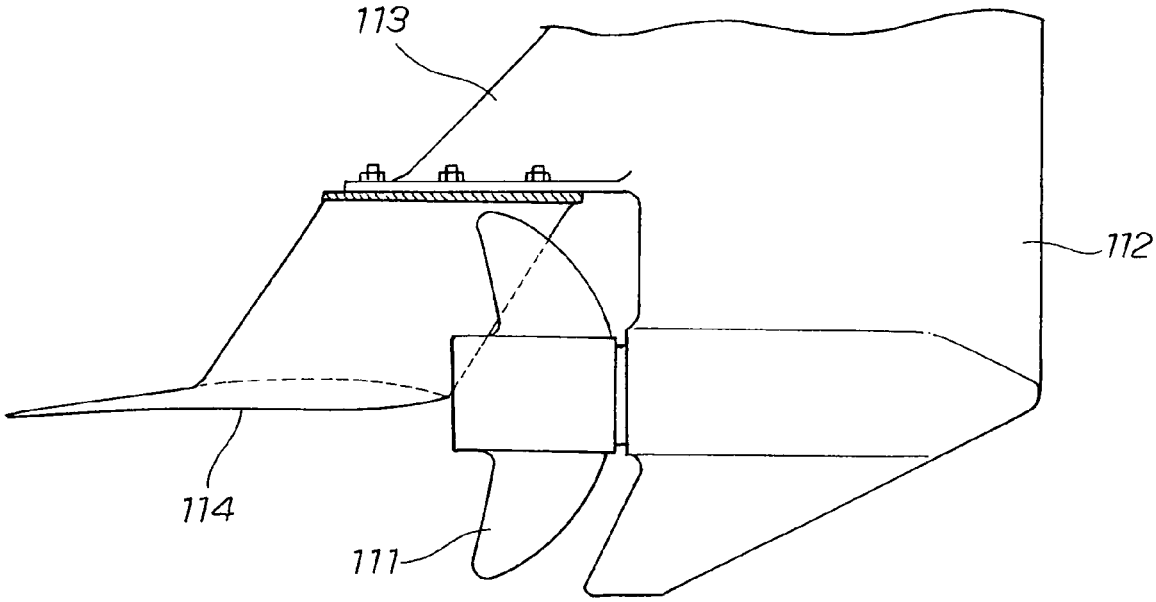
FIG.38 (PRIOR ART)
FIG. 38 is a partial enlarged view of the conventional marine propulsion apparatus.

The U-shaped wall part 78 is fitted onto the casing 12 where the rear section presents the shape of an artillery shell in the manner shown in FIG. 35, and is fastened to the casing 12 using bolts 85. The bolts 85 are covered by the decorative cover 67.

When a terrace part 79 is provided, the arm parts 81 can be shortened and there is no concern that the stays 15 will bend if horizontal force is applied.

Obviously, various minor changes and modifications of the present invention are possible in light of the above teaching. It is therefore to be understood that within the scope of the appended claims the invention may be practiced otherwise than as specifically described.

What is claimed is:

1. A marine propulsion apparatus adapted to be mounted on a stem of a hull for propelling the hull, the apparatus comprising:

a casing for supporting a propeller that propels the hull;

a cover extending upwardly from an upper end of the casing and surrounding an engine that drives the propeller;

an anti-cavitation plate extending transversely outwardly from the casing for reducing a cavitation phenomenon generated in association with rotation of the propeller;

a stay disposed above the anti-cavitation plate, said stay being attached to the casing and extending rearwardly from the casing; and a lift generation plate supported by the stay at a position rearward of the casing and above the anti-cavitation plate and extending in a width direction of the hull for generating lift during the propulsion, wherein when said hull is stopped, said stay is entirely submerged below a water level.

2. The apparatus of claim 1, wherein the lift generation plate has a wing tip plate extending vertically and in a front-and-rear direction at opposite ends thereof.

3. The apparatus of claim 1, wherein the lift generation plate is disposed such that a center thereof is offset to one of right and left sides from a center of the casing.

4. The apparatus of claim 1, wherein the lift generation plate has a plurality of marks where bolt holes are selectively formed to allow disposition of the lift generation plate at a desired offset position.

5. The apparatus of claim 1, wherein the stay has a distal end covered by a decorative cover.

6. The apparatus of claim 1, wherein the stay comprises a U-shaped wall part for fitting on a rear section of the casing, a terrace part extending rearwardly from an upper edge of the U-shaped wall part, and an arm part extending rearwardly from the terrace part.

7. A marine propulsion apparatus adapted to be mounted on a stern of a hull for propelling the hull, the apparatus comprising:

a casing for supporting a propeller that propels the hull;

a cover extending upwardly from an upper end of the casing and surrounding an engine that drives the propeller;

an anti-cavitation plate extending transversely outwardly from the casing for reducing a cavitation phenomenon generated in association with rotation of the propeller;

a stay disposed above the anti-cavitation plate, said stay being attached to the casing and extending rearwardly from the casing; and a plurality of lift generation plates supported by the stay at a position rearward of the casing and above the anti-cavitation plate and extending in a width direction of the hull for generating lift during the propulsion, wherein when said hull is stopped, said stay is entirely submerged below a water level.

8. The apparatus of claim 7, wherein the lift generation plates are spaced from each other in a vertical direction.

9. The apparatus of claim 7, wherein the lift generation plates are spaced from each other in a front-and-rear direction.

10. The apparatus of claim 7, wherein the lift generation plates have a same shape.

11. The apparatus of claim 7, wherein the stay comprises a U-shaped wall part for fitting on a rear section of the casing, a terrace part extending rearwardly from an upper edge of the U-shaped wall part, and an arm part extending rearwardly from the terrace part.

* * * * *